US010857586B2

(12) United States Patent
Frishman

(10) Patent No.: US 10,857,586 B2
(45) Date of Patent: Dec. 8, 2020

(54) SYSTEMS AND RELATED METHODS FOR MANUFACTURING RING PULL BOTTLE CROWNS

(71) Applicant: WORLD BOTTLING CAP, LLC, Plano, TX (US)

(72) Inventor: Abe Frishman, Carrollton, TX (US)

(73) Assignee: World Bottling Cap, LLC, Plano, TX (US)

( * ) Notice: Subject to any disclaimer, the term of this patent is extended or adjusted under 35 U.S.C. 154(b) by 268 days.

(21) Appl. No.: 15/698,122

(22) Filed: Sep. 7, 2017

(65) Prior Publication Data

US 2017/0368593 A1 Dec. 28, 2017

Related U.S. Application Data

(63) Continuation of application No. 14/700,865, filed on Apr. 30, 2015, now abandoned.

(60) Provisional application No. 61/986,521, filed on Apr. 30, 2014.

(51) Int. Cl.

| | |
|---|---|
| ***B21D 51/44*** | (2006.01) |
| ***B21D 51/48*** | (2006.01) |
| ***B21D 51/38*** | (2006.01) |

(52) U.S. Cl.

CPC ..... *B21D 51/443* (2013.01); *B21D 51/383* (2013.01); *B21D 51/446* (2013.01); *B21D 51/48* (2013.01)

(58) Field of Classification Search

CPC ..... B21D 51/38; B21D 51/383; B21D 51/44; B21D 51/443; B21D 51/446; B21D 51/48

USPC ... 413/68, 54, 14, 12, 15, 16, 17, 66, 67, 25

See application file for complete search history.

(56) References Cited

U.S. PATENT DOCUMENTS

| | | | | | |
|---|---|---|---|---|---|
| 3,366,086 | A * | 1/1968 | Fraze | B21D 51/383 | 413/14 |
| 4,760,729 | A * | 8/1988 | Kaminski | B21D 51/383 | 100/214 |
| RE33,061 | E * | 9/1989 | Brown | B21D 51/383 | 413/66 |
| 6,105,806 | A * | 8/2000 | Stasiuk | B65D 17/4012 | 220/269 |
| 6,533,518 | B1 * | 3/2003 | Turner | B21D 51/383 | 413/12 |
| 6,706,995 | B2 * | 3/2004 | Miller | B21D 51/383 | 219/121.68 |
| 6,808,351 | B1 * | 10/2004 | Brown | B65D 17/4012 | 413/14 |
| 2007/0181526 | A1 * | 8/2007 | Frishman | B65D 41/42 | 215/257 |

(Continued)

*Primary Examiner* — Gregory D Swiatocha

(74) *Attorney, Agent, or Firm* — Michael Best & Friedrich LLP

(57) ABSTRACT

Ring pull crowns require equipment and related methods for manufacturing. A method of manufacturing a ring pull crown includes forming a plurality of crown bodies from a first source material and forming a plurality of pull ring and tab assemblies from a second source material. In addition, such a method may include forming a plurality of ring pull crowns by combining each crown body of the plurality of crown bodies with a corresponding pull ring and tab assembly from the plurality of pull ring and tab assemblies. Also, such method may also include forming a circumferential skirt that descends below a top of each ring pull crown and removing the plurality of ring pull crowns from the first source material.

16 Claims, 24 Drawing Sheets

(56) References Cited

U.S. PATENT DOCUMENTS

| | | | | |
|---|---|---|---|---|
| 2008/0267736 | A1* | 10/2008 | Artrip | B21D 51/383<br>413/66 |
| 2010/0096355 | A1* | 4/2010 | Chaolu | B65D 41/42<br>215/304 |
| 2010/0200534 | A1* | 8/2010 | Frishman | B65D 41/12<br>215/253 |

* cited by examiner 900
901
910
902
903
904
901

904
901
920
902
921
903
901

901
930
903
902
931
904
932
901

SYSTEMS AND RELATED METHODS FOR MANUFACTURING RING PULL BOTTLE CROWNS

CROSS-REFERENCE TO RELATED APPLICATIONS

This application is a continuation of U.S. patent application Ser. No. 14/700,865, filed Apr. 30, 2015, which claims the benefit under 35 U.S.C. § 119(e) of U.S. Provisional Application No. 61/986,521, filed Apr. 30, 2014, both of which are hereby incorporated by reference in their entireties for all purposes. In addition, the disclosures of U.S. Pat. Nos. 8,061,544; 8,276,773; 8,365,940; 8,608,006; and 8,944,264; and U.S. patent application Ser. Nos. 14/098,208; 14/244,571; and 14/605,704, all by the same inventor, are also hereby incorporated herein by reference for all purposes.

BACKGROUND

1. Field of the Disclosure

This invention relates in general to sheet metal manufacturing processes, and more particularly to systems and related methods for manufacturing ring pull bottle crowns.

2. Background

A beverage bottle that opens manually with relative ease, without the use of a bottle opener, has been a long-felt need for beverage providers. Bottle caps must be tightly secured to the bottle opening to prevent spillage of the contents, loss of pressure (in the case of pressurized or carbonated beverages) and to maintain the hygienic conditions of the contents. The tight seal makes it difficult to open a bottle by hand.

Caps, also referred to interchangeably as crowns, are secured to the bottle opening by crimping the crown down over the open of the container in a series of concave arcs around the circumference of the opening. The arcs create sharp convex points between each concave arc. The arcs and points are often referred to by those skilled in art as "angles" or "flutes."

The advent of the familiar twist-off bottle cap was a significant advance for manual bottle opening, but all too frequently one has to grip the cap so hard to twist the cap free that the points of the cap angles inflict pain on the hands or fingers. To protect the hands from injury, it is a common practice to wrap the bottle cap in the tail of a shirt or in a cloth before twisting the cap.

Bottle caps adapted with pull tabs, similar to those used for beverage cans, have been known in China and other territories of Asia. See, for example, International Patent Application PCT/CN00/00040 by Liu, priority date Mar. 4, 1999, International Publication No. WO00/51906. Such ring pull crowns, however, are notoriously difficult to open because they require the exertion of an uncomfortable amount of force to break the seal and then pull the tab back (tearing the metal) to remove the cap.

Another pull tab solution for bottle caps is known as the MAXICROWN® such as is described U.S. Pat. No. 4,768,667, issued Sep. 6, 1988, to Magnusson. The MAXICROWN® provides a pull ring disposed along the side of the neck of the bottle as an extension of the crown and thus is problematic for use with standard angle-crimping bottle capping machines. Indeed, a special capping machine is recommended to cap bottles with the MAXICROWN®.

There is a need, therefore, for a bottle crown that is easy to open manually yet which may be tightly sealed around the bottle opening using standard bottle capping machines common in the art. Accordingly, there is also a need for an efficient process for manufacturing such a bottle crown.

BRIEF SUMMARY

In accordance with one aspect of the present invention, systems and related methods for manufacturing ring pull bottle crowns is provided which substantially eliminates or reduces disadvantages associated with previous systems.

In accordance with one embodiment, a method of manufacturing a ring pull crown is provided. The method includes the steps of forming crown bodies from a first source material, forming pull ring and tab assemblies from a second source material, and combining the crown bodies with the pull ring and tab assembles to form ring pull crowns. The method further includes the steps of forming a circumferential skirt around the ring pull crown and removing the ring pull crowns from the first source material. According to another embodiment, a system is provided that has one or more machines arranged and adapted to carry out the steps of the above method.

Other embodiments may be employed with containers for products other than a beverage, such as soup or stew, where a large mouth opening provides easy access to the contents. In addition, in other embodiments, ring pull crowns may be manufactured in accordance with the disclosed principles for containers such as medical vials or other small mouth containers. In short, the principles disclosed herein may be employed to manufacture ring pull crowns and lids for any size or type of containers.

One advantage of the systems and related methods for manufacturing ring pull bottle crowns, is that production equipment can manufacture the ring, tab, rivet, and cap using a single machine. Alternatively, a set of machines may be used as well. Another advantage of the invention(s) disclosed herein, is that a pull ring can be produced in a separate color from the crown body. Yet another advantage is that printed material can appear on the crown surface, rivet, and corrugation.

BRIEF DESCRIPTION OF THE DRAWINGS

For a more complete understanding of the present invention and its advantages, reference is now made to the following description and the accompanying drawings, in which.

DETAILED DESCRIPTION

In view of the foregoing, through one or more various aspects, embodiments and/or specific features or sub-components, the present disclosure is thus intended to bring out one or more of the advantages that will be evident from the description. The present disclosure makes reference to one or more specific embodiments by way of illustration and example. It is understood, therefore, that the terminology, examples, drawings, section headings, and embodiments are illustrative and are not intended to limit the scope of the disclosure. The terms "crown" and "cap" may be used interchangeably in the description that follows.

Ring Pull Crown

Figure 1:
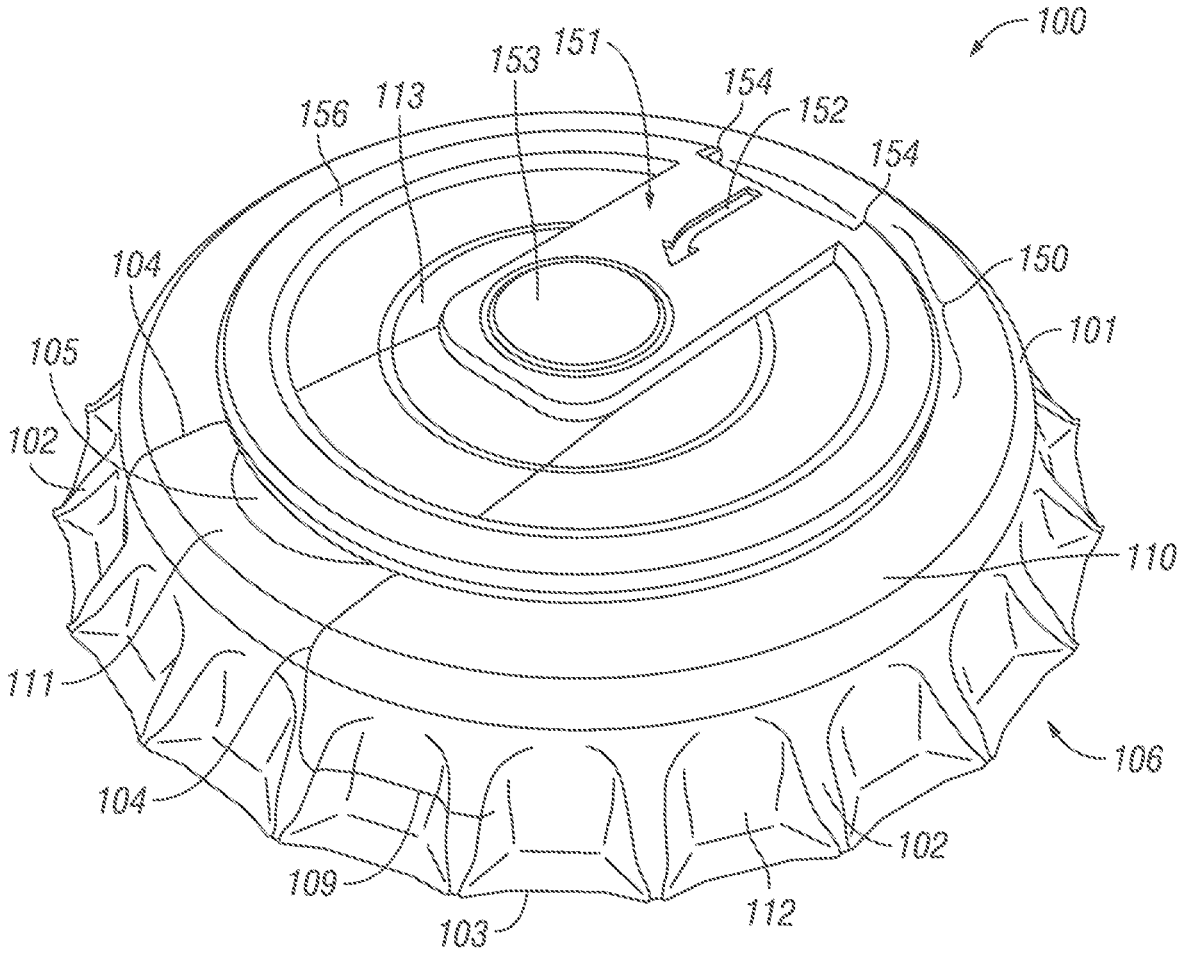
FIG. 1 illustrates an exemplary ring pull crown in perspective.

FIG. 1 illustrates a perspective view of an exemplary ring pull crown 100 that may be manufactured according to one or more of the embodiments disclosed herein. The pull tab bottle crown 100 has a crown body 110 attached by a rivet 153 to a pull ring and tab assembly 150. The crown body 110, which is usually formed from tinplate, includes a center portion surrounded along its shoulder 101 by a corrugated skirt 106. The corrugated skirt 106 shown in FIG. 1 is formed of a plurality of alternating flutes 102 (also referred to herein as "angles") and lands 112 that bisect the shoulder 101 and skirt edge 103.

Skirt 106 descends from top 110 along the external perimeter of crown 100 and in specific exemplary embodiments smoothly merges into a downwardly and radially outwardly extending flange. The skirt 106 is preferably adapted to be crimped onto the neck of a bottle for sealing. Specific exemplary embodiments of skirt 106 are divided into undulating, repeating portions that define the flutes 102 and lands 112. Preferably, the repeating portions are circumferentially evenly spaced apart such that each flute 102 is identical to all other flutes 102 around the circumference of the crown 100, and each land 112 is identical to all other lands 112 around the circumference of the crown 100. It should be understood that the crown 100 may include any number of flutes 102 and lands 112.

Moreover, the length of the skirt 106 extending below the top surface of the crown body may be of any length for use in bottle capping or other applications, which includes "short height" crowns, "intermediate height" crowns, or "standard height" crowns for use on bottles or other containers having openings with a variety of lips sizes configured to receive the crown. For example, industry standards typically refer to "standard height" crowns as those having a height, as measured from the top surface of the crown to the bottom edge of the skirt, of about 6.4-6.6 mm±0.15 mm, "intermediate height" crowns as those having a height of about 6.0-6.2 mm±0.15 mm, and "short height" crowns as those having a height of about 5.0-5.2 mm±0.15 mm. Moreover, as mentioned above, crowns manufactured in accordance with the disclosed techniques includes the manufacture of crowns of any size and for any container application, such as diameters between 26 mm and 29 mm, or even smaller or larger diameters. Thus, no limitation to any particular crown or skirt shape, style or size should be implied in the present disclosure. Likewise, the presence of a corrugated skirt on a crown manufactured in accordance with the disclosed principles is not required, and instead a smooth skirt, such as those used in the medical vials or similar applications, may also be formed with the disclosed manufacturing principles.

A ring pull crown 100 may be secured to a container by crimping the skirt 106 around the circular outer lip edge of the container. The crown body 110 may also include a rubber or plastic liner on the bottom side of the cap (not shown in FIG. 1), which is compressible to facilitate an airtight seal when the crown 100 is crimped to the container. In some embodiments, a liner may be mounted on the under surface of crown 100 with a suitable adhesive and disposed so as to cover the bottom of rivet 153.

Score lines 104 (also referred to herein as "score lines") generally taper inward from the skirt edge 103 toward the approximate center of crown 100 to provide a tapered tearing groove along the outline of a wedge-shaped tongue 111. For example, the depth of the tapered groove may graduate from a depth in the range of approximately 0.03 to 0.02 mm near the skirt edge of crown 100 to a depth in the range of approximately 0.10 to 0.08 mm by rivet 153 near the center of crown 100. In a preferred embodiment, one of the score lines 104 provides an S-curve or tail segment 109 that extends along the skirt 106 of crown 100. The S-curves are advantageous in that they permit the torn portion of the crown to remain attached to the remainder of the crown body. In other embodiments, however, the score lines 104 may also be formed straight, if desired.

By varying the depth of the score along cutting line 104, crown 100 provides a tearing groove which makes it more likely that only a reasonable amount of manual force is called upon to tear open crown 100. As will be discussed in more detail below, a recommended range of dimensions and material composition of crown 100 are disclosed to further provide a crown that may be manually opened with only reasonable force.

The present disclosure contemplates alternative degrees of divergence of score lines that instead converge toward rim 103. The score lines may even be substantially parallel, convergent, or divergent, and the selected degrees or angle separating the lines, is a matter of design choice, as is the number of score lines, which may be as few as one or even zero. Accordingly, the present invention contemplates all and every permutation of score lines which may be selected for the engineering design of a particular crown.

In a preferred embodiment, one of the score lines 104 provides an S-curve or tail segment 109 that extends along a portion of the skirt 106 of crown 100. S-curve 109 may facilitate the removal of crown 100 from a container opening. In operation, a person tears from the center of the cap along score lines 104. When the tear reaches S-curve 109, the tearing force follows the S-curve away from cut line 104 and impels the tear along the opposite cut line 104 to terminus 109 which breaks open crown 100. Continued tearing force along S-curve 109 pulls the portion of the skirt 106 away from the container opening (not shown) and releases crown 100 from the container (not shown). S-curve 109 consists of a scoring line having an upper radial segment extending from the opener assembly to the skirt 106 along a radial axis and a lower annular segment extending circumferentially along the skirt 106 in an annular direction and extending from a terminus of the upper radial segment, the lower annular segment defined in a second horizontal plane equidistant to the first horizontal plane associated with the lower edge of the skirt 106.

The pull ring and tab assembly 150 is connected by a rivet 153 to the tip of the tongue 111 of the crown body 110 in order to facilitate easy opening of the crown 100 along the score lines 104. The pull ring and tab assembly 150 includes a pull tab 151 that is connected to a pull ring 156 at the pull tab's fulcrum end 154. In preferred embodiments, the pull tab 151 may be embossed or printed with an instructional symbol 152 (e.g., a bent arrow) that suggests the manner of opening the crown 100. Further instructions may be provided with printed instructions, which may read, for example: "LIFT RING PULL UP TO REMOVE." Additionally a caution warning may be printed on crown 100. The other end of the pull tab 151 has a rivet hole that permits the pull ring and tab assembly 150 to be joined with the crown body 110.

The center portion of the crown 100 may also include recessed concentric subsections that enable the pull ring and tab assembly 150 to sit within the crown body 110 substantially flush with the crown shoulder 101. One of the advantages of a ring pull crown 100, arranged as depicted in FIG. 1, is that the pull ring and tab assembly sits recessed within the crown body such that it can be used with preexisting bottling equipment originally designed to work with conventional crown bodies. A plurality of recesses 107, 113 within the crown body 110 also add cross-sectional strength to the crown 100, thus enabling the crown body 110 to be made from thinner tinplate, which yields per piece cost savings.

To open the ring pull crown 100, a user may insert a fingertip or fingernail (or some other lever object) under the pull ring 156 and lift up on the pull ring 156 to separate the tip of the tongue 111 from the crown body 110. In certain preferred embodiments, such as the embodiment depicted by FIG. 1, the crown 100 may feature an ergonomic fingernail groove 105 that makes it easier to insert a fingernail under the pull ring 156.

Figure 2:
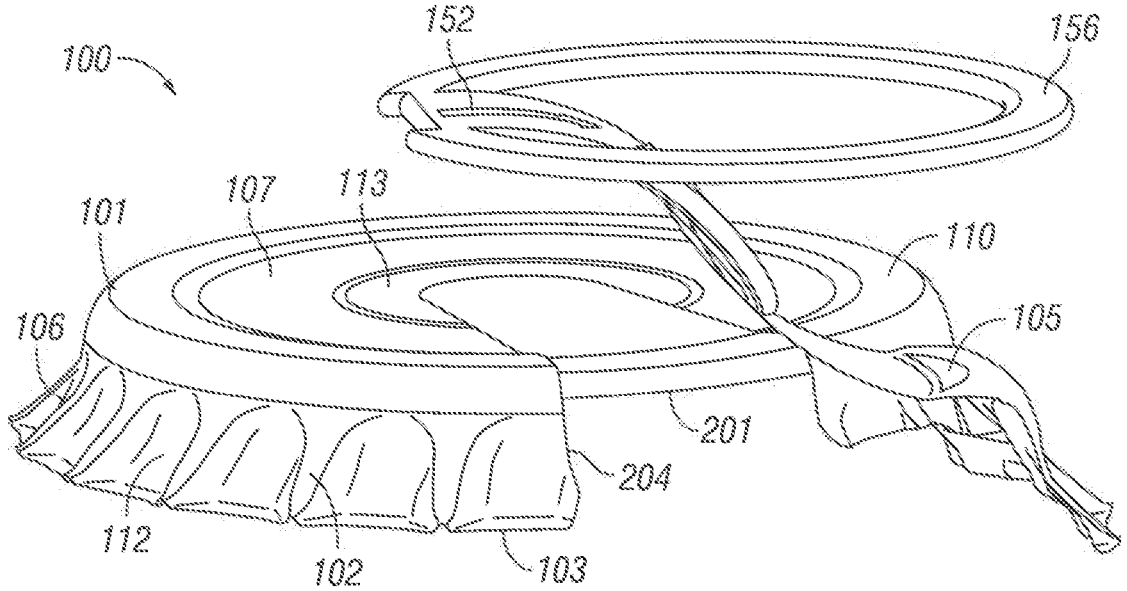
FIG. 2 illustrates, in perspective, an exemplary ring pull crown that has been opened.

When the end of the pull ring 156 opposite the fulcrum cut 154 is lifted upward and away from the crown body 110, the imaginary plane formed by the pull ring 156 acts as a first lever that rotates about the axis formed by the two points of the fulcrum cut 154. As the pull ring 156 rotates upwards, the end of the pull tab 151 nearest the fulcrum cut 154 is lifted from the surface of the crown body 110. The pull tab 151 then acts as a second lever arm that applies upward force to the rivet 153 located at the opposite end. The rivet 153 transfers the upward force to the tongue 111 of the crown body 110 sufficient to separate the tongue 111 from the crown body 110 via the score lines 104. Once the tip of the tongue 111 has been initially separated from the crown body 110, the user may insert his or her finger through the pull ring 156 and use it to easily tear the remainder of the tongue 111 from the crown body 110 along the tear lines 104. Importantly, as shown in FIG. 2, the tongue 111 is never fully separated from the crown 100. Additionally, once the pull ring is lifted from the crown body, the ring and tab assembly cannot be reset and actually functions as a taper proof indicator.

In particular, tinplate material which demonstrates an approximate hardness of T4 on the Rockwell 30T Hardness Scale is preferred for the exemplary cap illustrated in FIG. 1, although embodiments of T3 and T5 are advantageous for particular products. The preferred soft tinplate material requires less force to open and tear with the opener assembly of the exemplary cap illustrated in FIG. 1 while still providing sufficient sealing of the container contents. For the purposes of this disclosure, tinplate refers to any material, including tin or tin alloys, from which a crown may be fabricated and does not necessarily mean that the crown is made from tin or a tin alloy. Alternately, the ring pull and tab assembly may be produced from a resin or other plastic material, and may include metal filings or other material blended therein so as to add magnetic properties to the ring and tab assembly. Accordingly, the ring and tab assemblies, and thus the completed crowns, maintain magnetic properties for use with bottling equipment.

A pulling force for a pull ring of the present disclosure of approximately 2.5 kg (kilograms) or less is preferred. A relatively small pull force such as this is recommended so that virtually everyone will have sufficient strength to open a bottle using a crown of the present disclosure. In contrast, a relatively large pull force has the disadvantage of requiring a great amount of initial force to tear the tinplate material, and once the tinplate is torn open the sudden release of pulling force causes the bottle to jerk away from the user, spilling the contents often in dramatic fashion.

In addition to the low hardness of the tinplate, the thinness or gauge of the crown may also contribute to achieving a small pull force. For example, a crown of the present invention is recommended to have a thickness of less than 0.28 mm. For example, typical bottle crowns have a thickness of about 0.21 mm. Embodiments in which the crown material is strengthened by corrugation, such as in seated embodiments, may be thinner than standard crowns, having, for example, a gauge as thin as approximately 0.16 mm and even as thin as 0.12 mm.

In addition to the foregoing embodiments described above, an additional embodiment provides a reduced gauge crown that delivers additional advantages. Billions of bottle caps are used worldwide and the cost of the caps is largely determined by the amount of material required for the caps. One way to reduced such costs is to reduce the amount of material used in each crown. The amount of material can be reduced by making the crown thin, or reducing the gauge of the crown. A reduced gauge could be achieved by using less material but this might compromise the integrity of the crown by making the crown weaker. Another approach would be to use less material but use a stronger material. However, stronger materials might be more expensive than standard tinplate typically used in crown manufacture, which would defeat the cost savings purpose. An approach that reduces the amount of material but uses the same material without compromising strength is to corrugate the crown.

In an alternative embodiment (not shown), one or more spoilage indicators, such as dimples depressed in crown 100, may be positioned so as not to be obscured by the pull ring apparatus of the present disclosure. For containers that are vacuum sealed, spoilage indicators pop up in the event that the pressure seal is lost.

FIG. 2 illustrates, in perspective, the exemplary ring pull crown 100 of FIG. 1, which has been opened. FIG. 2 depicts the crown 100 further open along frangible score line 104 such that crown 100 could be easily detached from a container (not shown). A transparent or opaque liner 201 is revealed by the tearing away of the tongue from the crown 100. Notably, score line 204 does not extend to the edge 101 of the skirt 106 so as to maintain the crown 100 as a unitary piece upon removal from the container. In some embodiments, the tongue portion 111 is longer than the corresponding portion in the embodiments previously described herein due the off-center position on the opener assembly.

Figure 3A:
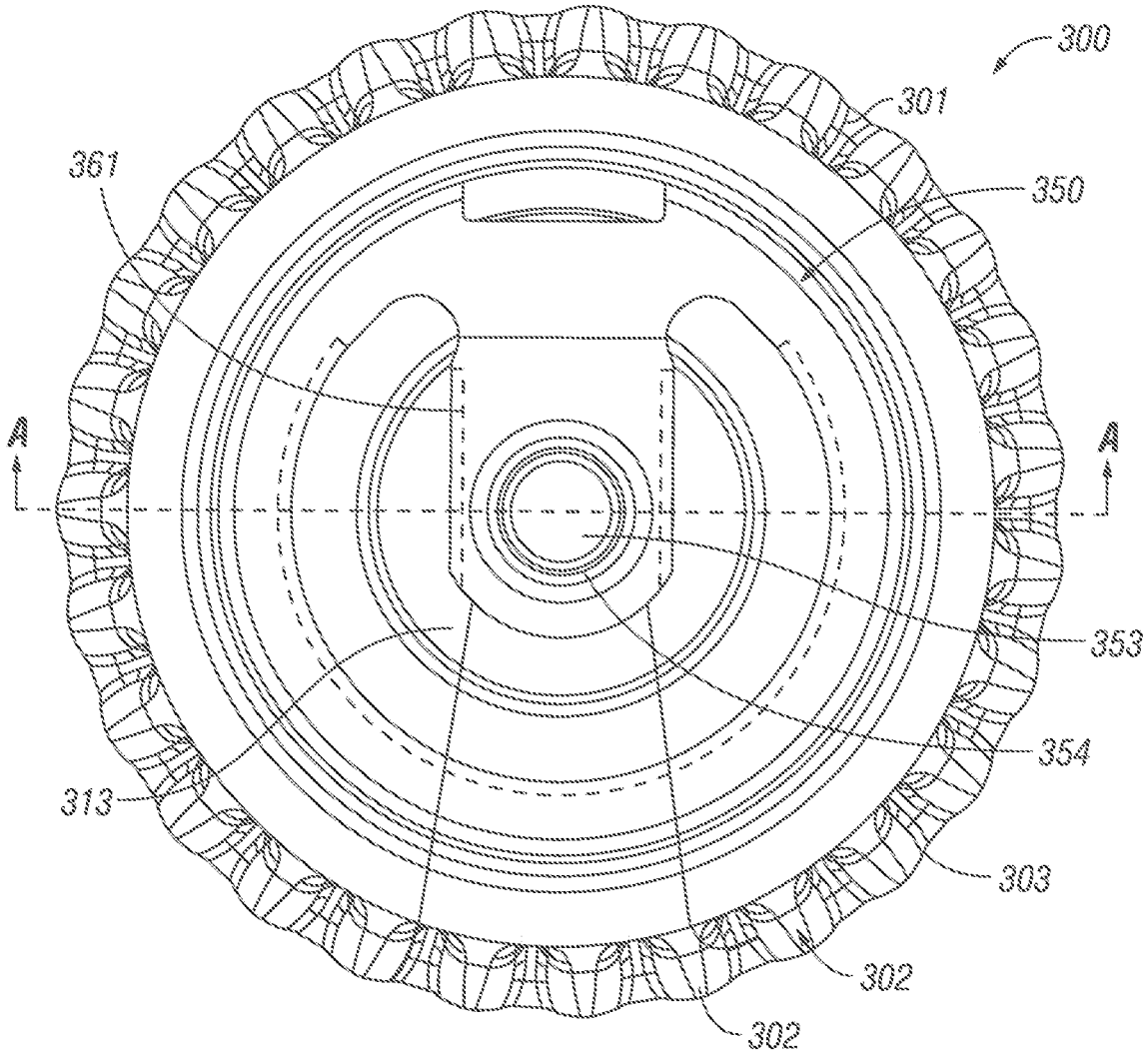
FIG. 3A illustrates a top view of an exemplary ring pull crown.
Figure 3B:
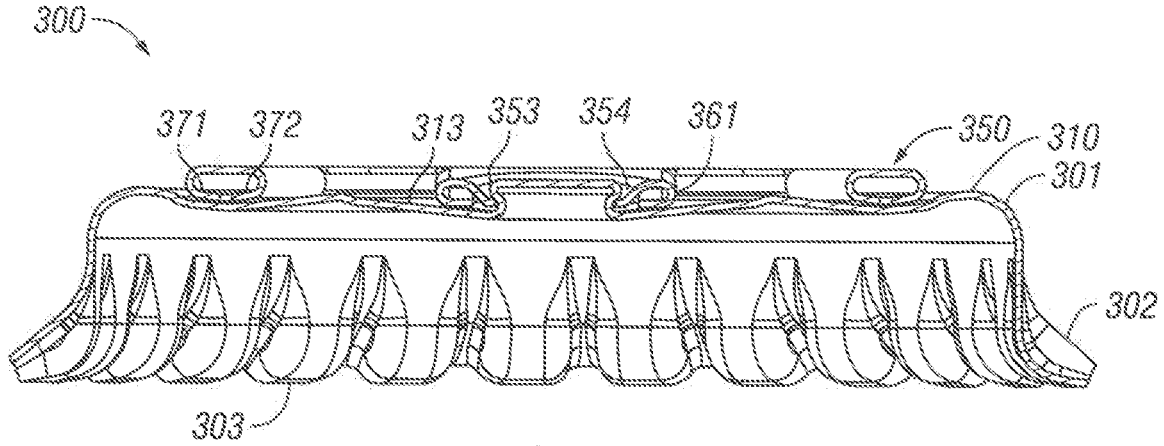
FIG. 3B illustrates a cross-sectional view taken along line D-D of the exemplary ring pull crown of FIG. 3A.

FIG. 3A illustrates a top view of an exemplary ring pull crown that may be manufactured in accordance with the disclosed principles. Relatedly, FIG. 3B illustrates a cross-sectional view taken along line A-A of the exemplary ring pull crown of FIG. 3A. The ring pull bottle crown 300 has a crown body attached by a rivet 353 to a pull ring and tab assembly 350. The crown body includes a center portion surrounded along its shoulder 301 by a corrugated skirt with angles 302. The crown body also features one or more recessed portions 313 that add structural strength. The pull ring and tab assembly 350 is connected by a rivet 353 to the tip of the tab of the crown body in order to facilitate easy opening of the crown 300 along the score lines. The pull ring and tab assembly 350 includes a pull tab, attached to the pull ring, with curled wings 361. The other end of the pull tab has a rivet countersink 354 through which the pull ring and tab assembly 350 is connected to the crown body via a rivet 353. As can be seen in FIG. 3B, the pull ring is formed using curled edges (371, 372).

Skirt 303 descends from shoulder 301, which is contiguous with top 310. Seat 313 is of sufficient depth that pull ring 350 is substantially flush with the top 310 of crown 300. Such an embodiment advantageously is suitable for use in conventional bottle capping machines without having to re-tool or refit the machine. A further advantage of seat 313 is that seat 313 forms a corrugated perimeter around the seat and corrugation is well known to strengthen flat sheets against bending in directions substantially perpendicular to the direction of corrugation. Seat 313, therefore, provides the additional advantage of strengthening crown 300. A further advantage of a strengthened crown 300 as provided by seat 313 is that the thickness of crown 300 may be reduced to a lower gauge (thinner) crown material than would be utilized in a standard crown, thus lowering the costs of manufacturing materials.

In alternate embodiments, seat 313 may be shallower so that pull ring assembly 350 is seated slightly or partially above the shoulder 301 of crown 300. Such an embodiment may provide the advantage of having pull ring 350 easily accessible for manual opening. Depending on the acceptable tolerances, such an embodiment may also be suitable for use with a standard bottle capping machine.

Crown Body

Figure 4A:
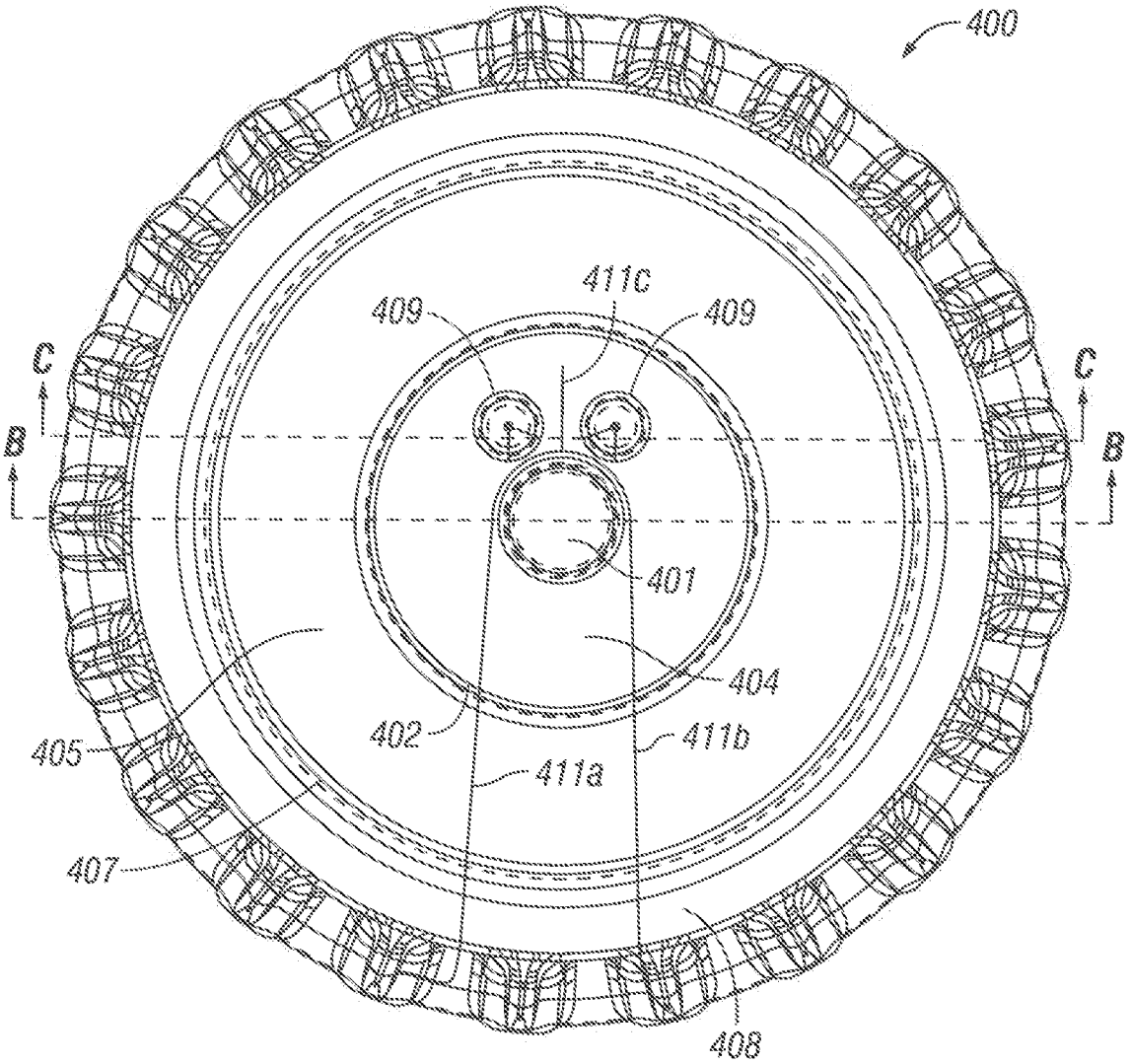
FIG. 4A illustrates a top view of an exemplary crown body.
Figure 4B:
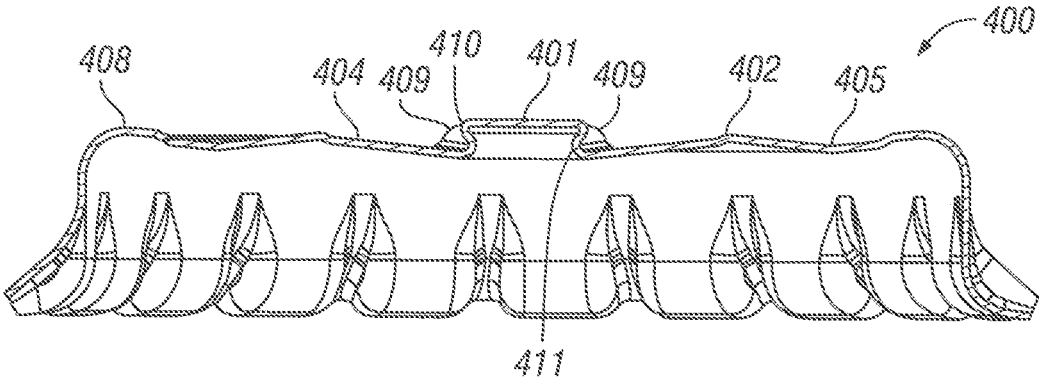
FIG. 4B illustrates a cross-sectional view taken along line C-C of the exemplary crown body of FIG. 4A.
Figure 4C:
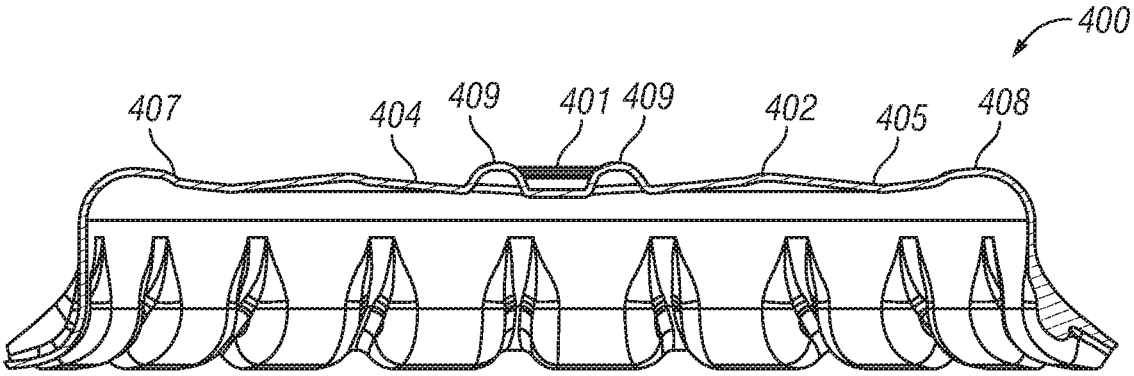
FIG. 4C illustrates a cross-sectional view taken along line D-D of the exemplary crown body of FIG. 4A.

FIG. 4A illustrates a top view of an exemplary crown body 400 manufactured in accordance with one or more embodiments of the disclosed principles. Additionally, FIGS. 4B and 4C are provided to illustrate cross-sectional views taken along lines B-B and C-C (respectively) of crown body 400, which is shown without a pull ring and tab assembly attached. As can be seen from the various views, seat 405 is recessed, that is, it is lower than top 408 but is contiguous with top 408 by virtue of transition surface 407, which will be referred to herein for convenience as recess 407. Recess 407 may be formed in crown 400 in a variety of suitable ways to provide advantageous shapes. For example, in specific exemplary embodiments, concentric tiers, rings, grooves, or steps are integrally formed in the crown 400 material until the desired depth of seat 405 is obtained. In alternative embodiments, recess 407 is formed with a smoothly curved surface from top 408 to seat 405. The form of recess 407 functions as ribs or structural reinforcements that, it is surmised, help to stiffen seat 405 against deflection or deformation. Within recesses (404, 405), dimples 409 may be formed adjacent to rivet 401. Dimples 409 may be disposed in various positions on the top of the cap body in order to provide better leverage for the pull ring during opening, and may even provide spoilage indication as mentioned above.

In the exemplary embodiment shown in FIGS. 4A-4C, rivet 401 is integrally formed on and from the same material that makes up the crown body 400 by punching or pressing a stud up from the crown body top surface. The rivet 401 has a flared head 410 that is supported by a neck 411, which may be recessed. The rivet 401 may be secured to another structure that has rivet hole by inserting the rivet 401 into the rivet hole and compressing the rivet head 410 down over the lip of the rivet hole such that the lip is compressed between the rivet head 410 and the base of the rivet's neck. In alternative embodiments, a crown body may instead be punched with a rivet hole in order to permit a separate rivet to be driven between the rivet holes of both the crown body and the pull ring and tab assembly. In addition, the score lines for use in tearing and opening the crown 400 are again illustrated. However, in addition to first and second score lines 411*a* and 411*b*, the disclosed principles may also for a third, rear score line 411*c*, the function of which is described in further detail below.

In some embodiments, the stiffness and compressive strength of crown body 400 may be improved through corrugation. As shown by FIGS. 4B and 4C, a specific amount of material strengthening from corrugation is achieved, for example, by selecting an embodiment with a particular combination of seat diameter and recess depth. For instance, one embodiment might feature a seat diameter, which is relatively wide, and a recess depth that is intermediately deep. Other embodiments might have a seat width of intermediate width and a relatively deep recess depth. Of course, other combinations of seat diameter, recess depth, the number of recesses, or even transition surface angle may be selected in accordance with certain design or engineering goals.

Corrugation strengthens materials. This is particularly true of laminar materials formed into a sheet or plane. A laminar product can use less of a material if the material is corrugated to provide lateral strength. A bottle cap is a laminar product in which the sheet material, often steel or tinplate, is shaped to be affixed to the top of a bottle or other container. A standard pry-off or twist-off cap has a thickness of material that is predominantly determined by considerations of leak prevention and the secureness of the attachment of the cap to the container. Corrugation allows caps that use less material to have the equivalent strength of a standard thick crown. A corrugated crown is thinner, that is, it has a reduced gauge, in comparison to a standard bottle cap. An advantage of such a "reduced gauge crown" (RGC) is the money savings obtained by using less material.

Another advantage of a reduced gauge corrugated cap comes into play with innovated "pull-off" caps, which have a pull tab assembly attached to the crown as described herein. The pull tab breaks the cap material and the crown is torn off the bottle using the pull ring of an opener assembly. A reduced gauge crown facilitates the tear off because the cap material is thin and the tearing action is parallel to the direction of material strengthening provided by the corrugation and therefore the tearing force does not have to overcome the material strengthening of the corrugation. Corrugation affords material strengthening perpendicular to the direction of corrugation.

In addition to the structures illustrated in the figures herein, it is understood that other structures will imbue a cap of the present disclosure with the advantages of corrugation and provide a reduced gauge crown for a bottle. For instance, concentric rings, which progress from the top of the skirt toward the center of the seat, and decorative shapes such as stars, brand logos, sports team logos, religious insignia, and the like, formed in the plane of the cap, are embraced in the present disclosure.

Corrugation forms may be provided to a bottle cap by a variety means, including without limitation, metal stamping, pressing, embossing and so forth. Non-metal crowns of the present disclosure may be formed by injection molding for plastic crowns, or by other suitable means of production. In addition, non-metal materials may also be used to form the ring and tab assembly either a part of the disclosed manufacturing process, or as a prior process that provides the formed ring and tab assemblies for mounting on the disclosed crown bodies. The use of non-metal materials in combination with the disclosed manufacturing techniques is discussed in further detail below.

Pull Ring and Tab Assembly

Figure 5A:
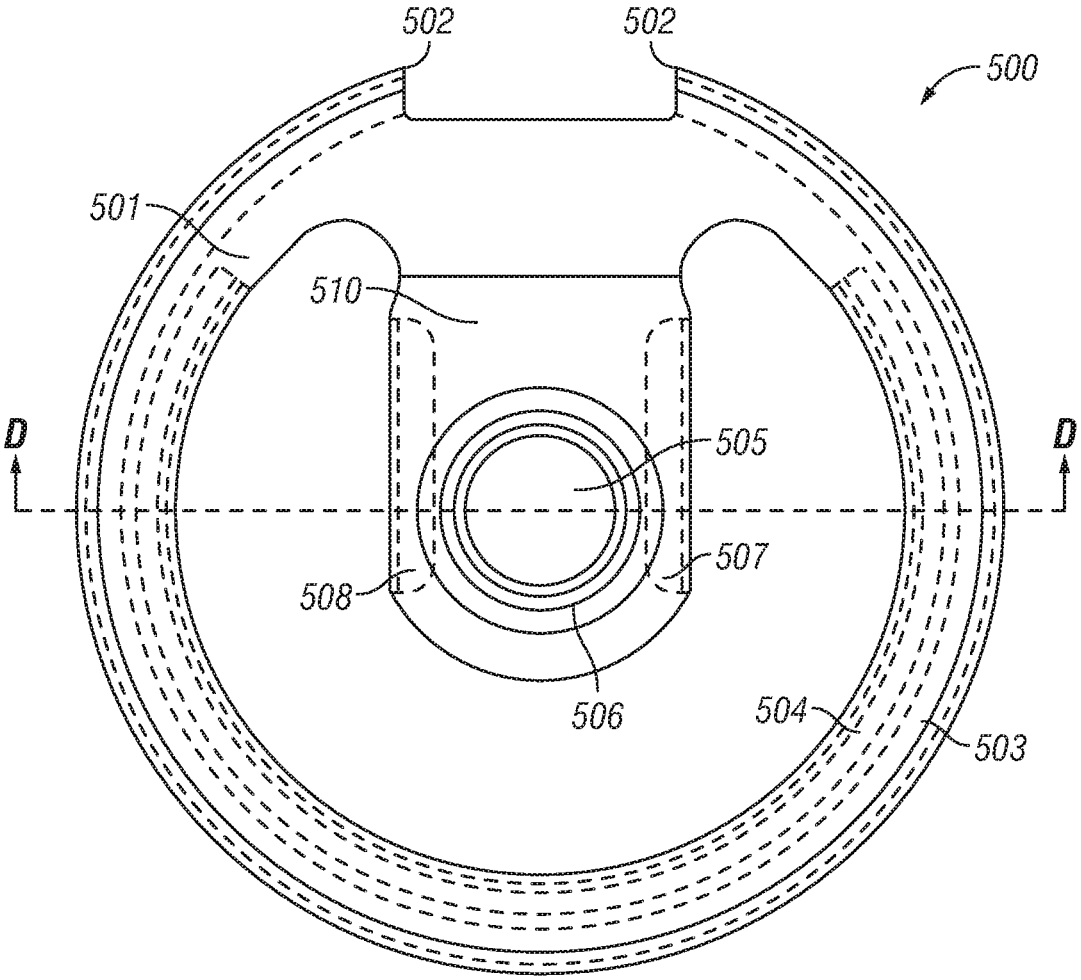
FIG. 5A illustrates a top view of an exemplary pull ring and tab assembly.
Figure 5B:
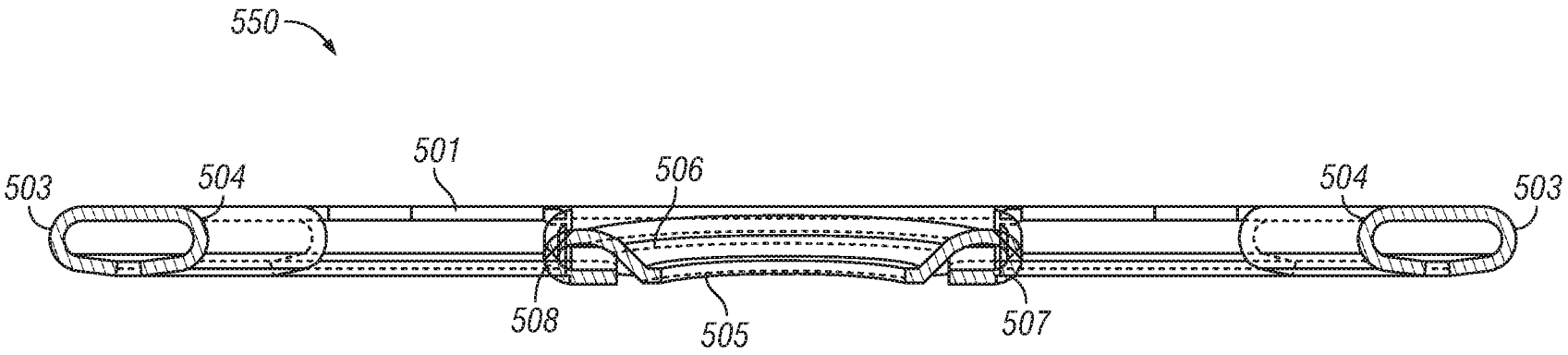
FIG. 5B illustrates a cross-sectional view taken along line C-C of the exemplary pull ring and tab assembly of FIG. 5A.

FIG. 5A illustrates a top view of an exemplary pull ring and tab assembly 500. Relatedly, FIG. 5B illustrates a cross-sectional view taken along line D-D of the exemplary pull ring and tab assembly 500 of FIG. 5A. The pull ring and tab assembly 500 has a pull ring 501 connected at an interior edge to a pull tab 510. The pull ring and tab assembly 500 is designed to be attached to a crown body using a rivet. Accordingly, the pull tab 510 has a rivet hole 505 through which the rivet may be driven to attach the assembly 500 to a crown body. In preferred embodiments, the rivet hole 505 may be surrounded by a recess or countersink 506 to provide a flush fitting with a rivet. In such embodiments, the pull tab 510 may also feature curled wings (507, 508) to provide structural support for the tab 510 and countersink 506 if the pull tab 510 is formed from a sheet metal. If the pull tab 510 is formed from plastic, structure of the pull tab 510 may simply require enough thickness to avoid shearing or cracking when an opening force is applied to the pull ring 501, although any type of structure support formations may also be included for such non-metal pull rings and/or tabs.

In preferred embodiments, the edges of the pull ring 501 should be blunted in order to reduce the risk a person might cut his or her finger while opening a container using the pull ring. For example, as shown in FIG. 5B, the outer and inner pull ring edges (503, 504) have been curled or "rolled" to form a blunt outer surface. The curled edges (503, 504) also provide cross-sectional strength for the pull-ring 501 so that it will not bend under a reasonable amount of pulling force during a container opening operation.

The pull ring and tab assembly 500 may be formed from a variety of suitably stiff, inexpensive materials, such as: tinplate, steel, aluminum, or plastic. If a metallic material is used, the thickness of the material may be thinner than the material used for the crown body in order to reduce per unit costs.

Ring Pull Crown Manufacturing Process

Figure 6:
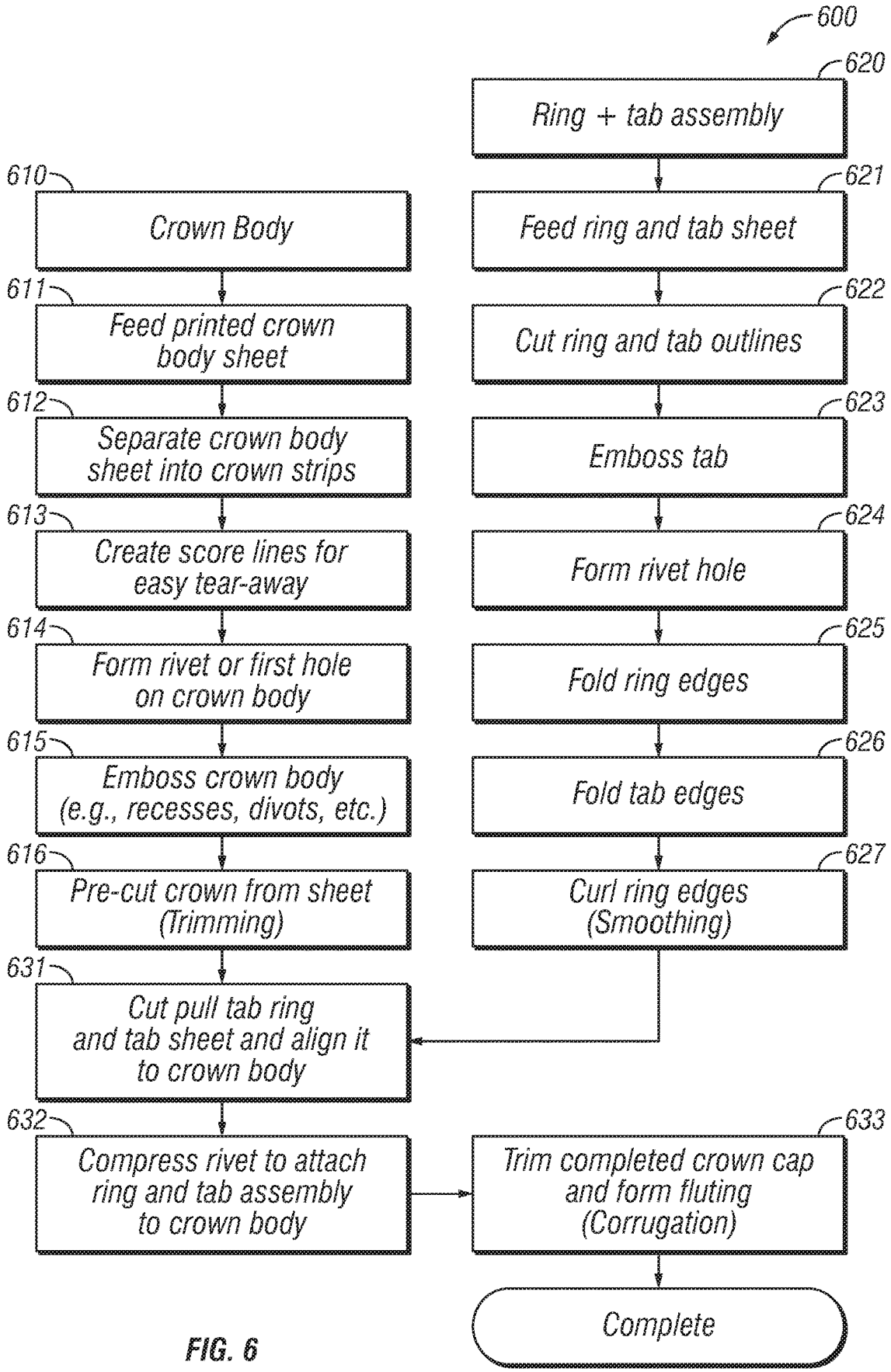
FIG. 6 is a flow diagram illustrating the steps of a manufacturing process for forming a ring pull crown in accordance with an embodiment.

FIG. 6 is a flow diagram illustrating the steps of a manufacturing process for forming a ring pull crown in accordance with an embodiment. In general, manufacturing process 600 begins with two parallel processes (610, 620) for separately forming the crown body and pull ring and tab assembly. The manufacturing process for forming a crown body 610 is described in further detail below with respect to FIGS. 7A, 7B, 7C, 8A, 8B, and 8C. Likewise, the manufacturing process for forming a pull ring and tab assembly 620 is described in further detail below with respect to FIGS. 9A-9I. After the constituent parts are formed, a third process is used to attach the pull ring and tab assembly to a corresponding crown body in order to form a ring pull crown. Once combined, additional manufacturing steps may be necessary to complete the assembled ring pull crown, such as corrugating or cutting. The third process is described in further detail below with respect to FIGS. 10-12.

In certain preferred embodiments, a die press may be used to form the crown body or pull ring and tab assembly. A die is a metal block that is used for forming materials like sheet metal and plastic. For the forming of sheet metal, two parts may be used: one, called the punch, performs the stretching, bending, and/or blanking operation, while another part, called the die block, securely clamps the workpiece and may provide similar stretching, bending, and/or blanking operation. The workpiece may pass through several stages using different tools or operations to obtain the final form. After the main forming is done, additional crimping or rolling operations may be performed to ensure that all sharp edges are hidden and to add rigidity to the various pieces being manufactured.

The crown body manufacturing process 610 begins at step 611 when a crown body sheet 700 is fed into a manufacturing system configured to carry out the manufacturing process 600. As illustrated, the crown body sheet 700 may be preprinted or pre-stamped with any number of colors, logos, writing, embossing, etc. as desired for the specific application of the crowns being manufactured. In step 612, the crown body sheet 700 is separated (sometimes referred to as "guillotined") into individual rectangular crown strips 701. During step 612, the ends of each strip 701 may be further punched out to form scalloped edges that aid in strip alignment. The individual crown strips 701 are then rearranged end-to-end and fed into equipment configured to form the crown bodies on each crown strip 701. Such pre-staging steps may be useful for providing a continuous feed of crown body source material to subsequent crown body formation steps (e.g., by conveyer line); however, such pre-staging steps may be altered or even omitted without departing from the scope of the present disclosure.

In steps 613 through 616, one or more crown bodies are formed in a series of stages using various die punches or similar manufacturing tooling. In step 613, a punch is used to form one or more score lines 104 on the crown body strip 701. In step 614, a punch is used to form a rivet or a rivet hole of a crown body. In step 615, the crown body may be embossed with features such as recessed portions, dimples, and/or seal indicators. In step 616, the crown body is trimmed. Each of these manufacturing steps will be described in further detail below, and should be understood throughout this disclosure that a greater or fewer number of steps may be included in a manufacturing process provided in accordance with the disclosed principles.

The pull ring and tab assembly process 620 begins at step 621 when a ring and tab assembly sheet is fed into equipment configured to form one or more pull ring and tab assemblies on the sheet. In one embodiment, the sheet is actually a coil or band material provided to the equipment disclosed herein, however, other types of source material for the ring and tab assemblies may also be employed. In step 622, a blanking punch may be used to cut ring and tab outlines. In step 623, the pull tab may be optionally embossed with features such as instructional symbols. In step 624, one or more punches may be used to form a rivet recess and rivet hole. In step 625, one or more punches may be used to stamp fold lines for the pull ring and to fold the stamped edges downwards. In step 626, one or more punches may be used to stamp fold lines for the pull tab and to fold the stamped edges downwards. In step 627, the ring edges and tab wings are curled and smoothed. As with the crown body formation, each of these manufacturing steps will be described in further detail below, and should be understood throughout this disclosure that a greater or fewer number of steps may be included in a manufacturing process provided in accordance with the disclosed principles.

The pull ring and tab assembly formed by process 620 is cut from the ring and tab sheet. In step 631, the formed pull ring and tab assembly is aligned with a corresponding crown body, which is still attached to a crown body strip 701. In step 632, the ring and tab assembly is attached to the crown body by using an independent rivet or by compressing the ring and tab assembly onto a rivet formed on the crown body itself. In step 633, the skirt of the assembled ring pull crown is formed and corrugated with fluted angles, or with a smooth skirt if the application calls for it. In the same or subsequent step, the completed ring pull crown is trimmed from the crown body sheet.

Crown Body Source Material

Figure 7A:
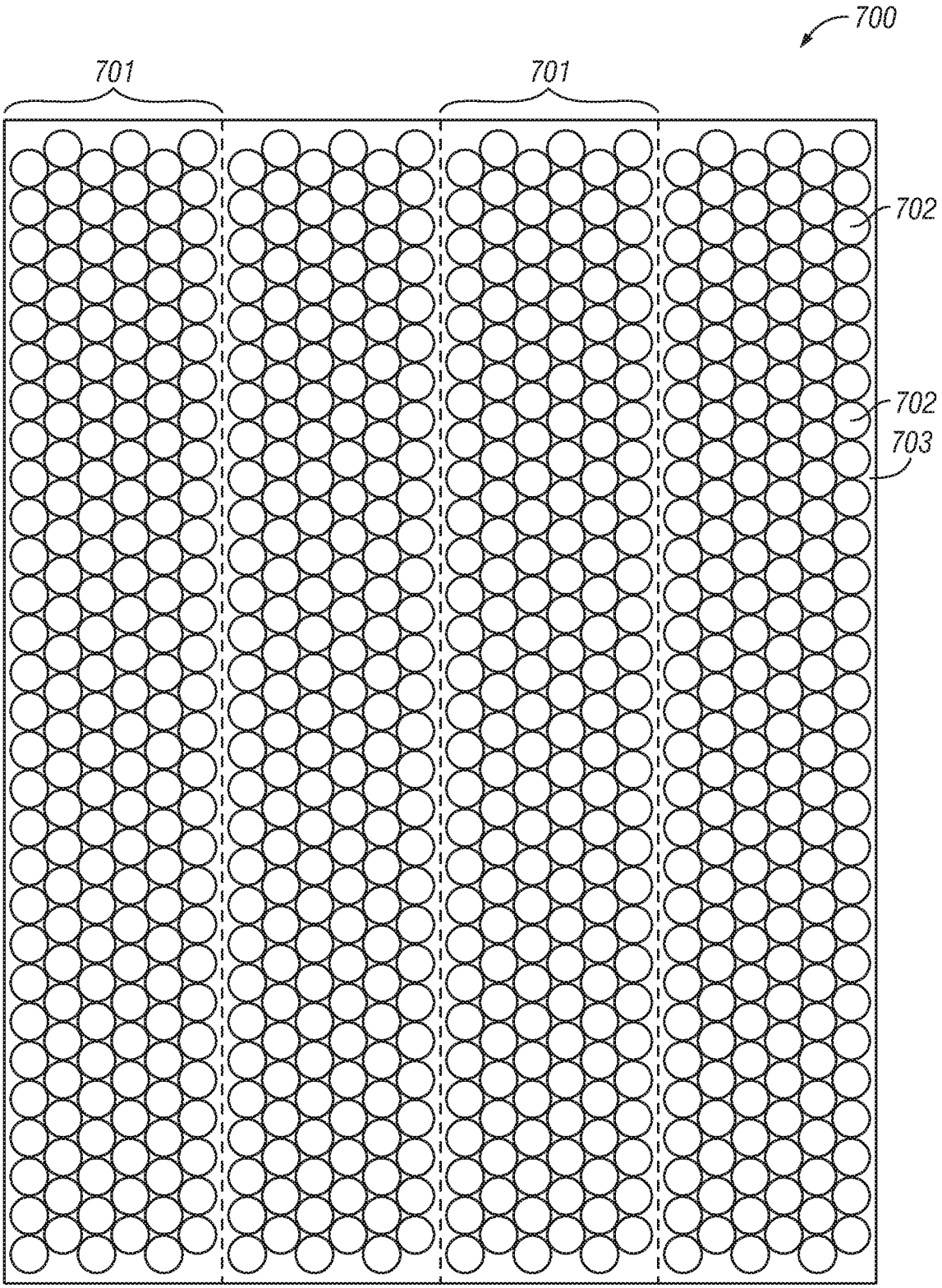
FIG. 7A illustrates an overhead view of a printed crown body sheet.

FIG. 7A illustrates cut sheets of printed or unprinted material, such as tinplate or other material appropriate for bottle crowns, prior to stamping. Preprinted sheets may be dyed, anodized, painted, stamped, embossed, or otherwise embellished with various designs or visual elements, such as a branding, printed text, or regulatory labeling. In the preferred embodiment shown in FIG. 7A, an optimal circle-packing pattern is used to minimize the amount of leftover scrap needed for the carrying web 703. In two-dimensional Euclidean space, the highest-density lattice arrangement of uniform circles is the hexagonal packing arrangement, in which the centers of the circles are arranged in a hexagonal lattice (staggered rows, like a honeycomb), and each circle is surrounded by six other circles. The density of this arrangement is given by the equation:

$$n = \frac{\pi}{2\sqrt{3}} \approx 0.09069$$

Arranged using such a pattern, the center points of any three adjacent crown body blanks 702 will form the vertices of an equilateral triangle, and a ray coextensive with a diagonal row of blanks 702 will form a sixty degree angle with the long edge of a crown body strip 701. Of course, other design or engineering factors may dictate that a different circle-packing patterns be used, such as: trihexagonal, square, elongated triangular, snub square, etc.

The type of material to be used for the crown body sheet depends in part on the type of ring pull crown to be manufactured. Specific embodiments of the corrugated crown caps described herein, such as embodiments for pry-off or twist-off, are formed with steel of increased hardness compared with conventional crown caps presently in commercial production. For example, conventional crown caps are often formed of single reduced, T4, tinplate having a thickness of from 0.21 mm to 0.23 mm. Such tinplate has an average hardness (that is, the reported hardness value regardless of +/−variations) of approximately 61 on a 30T hardness scale, in accordance with ASTM 623. Crown caps 100 described herein may be made thinner and lighter weight compared with the prior art, for example, crown caps may be formed of a material having a thickness of about 0.19 mm to 0.28 mm, or even as thin as 0.16 mm, that have the same or roughly equal performance as conventional, thicker caps. These decreases in metal usage are more easily achieved when the structure of crown caps 100 are made with steel having increased hardness. For example, the inventor has demonstrated the effectiveness of low gauge crowns having grooves using DR8 (according to ASTM 623) or DR550 (according to EN 10203). Optionally, the inventor surmises that other materials may be used, such as single reduced tinplate or like material having enhance tempering, tin-free steel having similar properties as those described herein, and the like.

The crowns 100 preferably have an average hardness of greater than 62 on the 30T scale (conforming to ASTM 623), more preferably greater than about 65, or even greater than about 68 or about 71, if the application calls for it. Some embodiments were demonstrated to be effective using steel having a hardness of 73. The upper limit of hardness is set by the maximum stress acceptable to the glass bottle during the crimping process or the spring back (which may tend to urge the crimped flanges toward an uncrimped state) associated with harder plate. Because hardness has a relationship to strength as reflected in the yield point, the aspect of the hardness of the crown may be expressed in yield point on a corresponding scale. For example, DR8 or DR550 tinplate may has a yield point (in a tensile test) of 550 MPA.

However, it will be understood that for pull tab opener embodiments, softer materials, such as softer tinplate than T4, or even aluminum for medical vial or other cap applications requiring aluminum or other soft metals, are advantageous because they facilitate ease of opening and tearing. The strength provided by corrugation permits the use of a relatively soft crown material while preserving the strength required for secure closure of the container. The inventor believes that the most advantageous crown cap embodiment has a combination of strength for secure closure and softness for ease of opening and tearing that is a matter of design and engineering choice. A crown of the present disclosure encompasses crown caps that do not have all of the structure, materials, and/or advantages in this specification.

According to this description, commercially acceptable crown caps formed according to the present disclosure can be commercially made with up to 25 percent less material (e.g., steel or tinplate) compared with many conventional crown caps, which has corresponding advantages in carbon emissions. The savings in material weight are approximately proportionate to the reduction in metal thickness. Further, even though energy required to cool an individual crown is tiny, the energy required to cool the total number of crowns produced each year (approximately 60 billion in North America and approximately 300 billion throughout the world), and the corresponding reduction in that energy, is significant.

The reduced gauge crown (RGC) discussed above has an impact on reducing the cost of the tinplate or steel, and the PVC, PVC-free, or oxygen scavenger liner material, which is available with an additive, making both the metal crown and PVC, PVC-free, or oxygen scavenger liner, biodegradable in an "active landfill". With the resulting lower production and weight in transportation costs in the RGC, in turn, reduce CO2 emissions. Tinplate or steel used to produce crowns for the beer or soda industry varies between 0.18 mm-0.24 mm. The present reduced gauge crown may use a thickness of between 0.12 mm-0.19 mm. A standard pry-off or twist-off crown, weighs approximately 2.38 grams, whereas the reduced gauge crown weighs approximately 2.14 grams, a 10% reduction in weight yielding a savings in material costs.

A further benefit of the reduced gauge crown is seen in the transportation costs of crowns. A reduction in weight relates to a savings in transportation fuel costs, wear and tear on the transportation vehicles, and reduced transportation carbon dioxide emissions. Standard bottle crowns are traditionally packed 10,000 per carton but with a reduced gauge crown embodiment, a carton holds 11,000 crowns, thus providing reduced energy, transportation, and carbon dioxide emissions. Thus, advantages of the reduced gauge crown embodiment include, without limitation, cost savings in production, lower price per crown, lower transportation costs, lower loading costs, as well as reduced carbon dioxide emissions.

In addition to all of the embodiments described herein, an additional feature is suitable for use with of each of the embodiments as a matter of engineering, design or marketing choice, which is the employment of temperature-sensitive color-changing ink, so-called thermochromic ink, such as described, for example, in U.S. Pat. No. 6,634,516 to Carballido, which is incorporated herein by reference in its entirety. Such thermochromic inks have the property of changing color so as to be one color at room temperature (approximately 21° C.) and a different color when refrigerated to, for example standard retail refrigeration temperature of 4° C. In an exemplary application, the ink is transparent, for example, at room temperature but becomes relatively opaque and visible at chilled temperature, such that a customer has visual confirmation of the approximate temperature without touching the container.

In preferred embodiments, the sheet metal used to form the crown bodies may include a scalloped edge on the ends of cut sheets for sheet material gap "nesting" during production. Additionally, such sheets may be cut in the same equipment as other parts of the manufacturing process disclosed herein, or may be pre-cut prior to being provided into equipment configured for the manufacturing process disclosed herein. Both ends of pre-printed or unprinted sheet of material would have scalloped edges punched out prior to feeding of the sheets for crown and tab production. Scalloped ends allows precision alignment from one cut sheet to the next as each sheet is fed into the crown body stamping portion of the manufacturing equipment. It should be noted that the scalloped shapes illustrated is only exemplary, and any advantageous shape of the ends of the sheets of material, or no scalloping at all, may be employed with the disclosed principles. Moreover, although cut sheets of material for the crown body are illustrated herein, the disclosed principles may also be implemented with rolled material or any other means for providing such material for crown stamping.

Figure 7B:
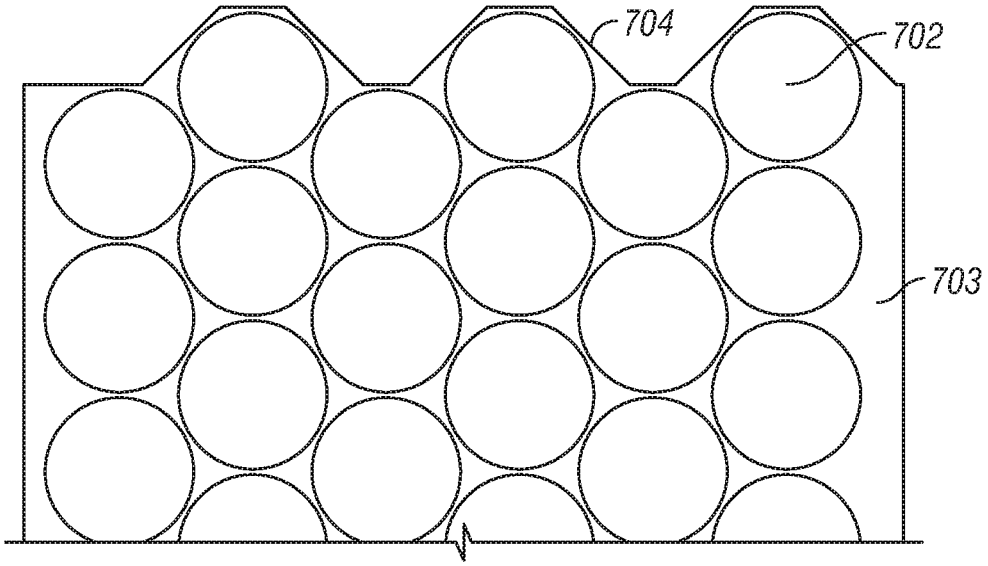
FIG. 7B illustrates an angular scalloped edge of a separated crown body sheet in accordance with an embodiment.

FIG. 7B illustrates an angular scalloped edge of a separated crown body sheet in accordance with an embodiment. The scalloped ends of preprinted or unprinted sheets of cut material facilitate zero-gap nesting between sheets fed for stamping of the crown body. Where a preprinted sheet is used, imprinted logos across each cut sheet are aligned at locations where each crown cap body will be stamped. The scalloped edges may be cut using known sheet metal cutting techniques such as metal stamping, laser beam cutting, plasma cutting, water jet cutting, or any other suitable technique for cutting sheet metal. Of course, the disclosed principles may be implemented with any number and/or alignment and arrangement of crown cap bodies, and thus the arrangement and spacing illustrated in FIG. 7B is only exemplary.

Figure 7C:
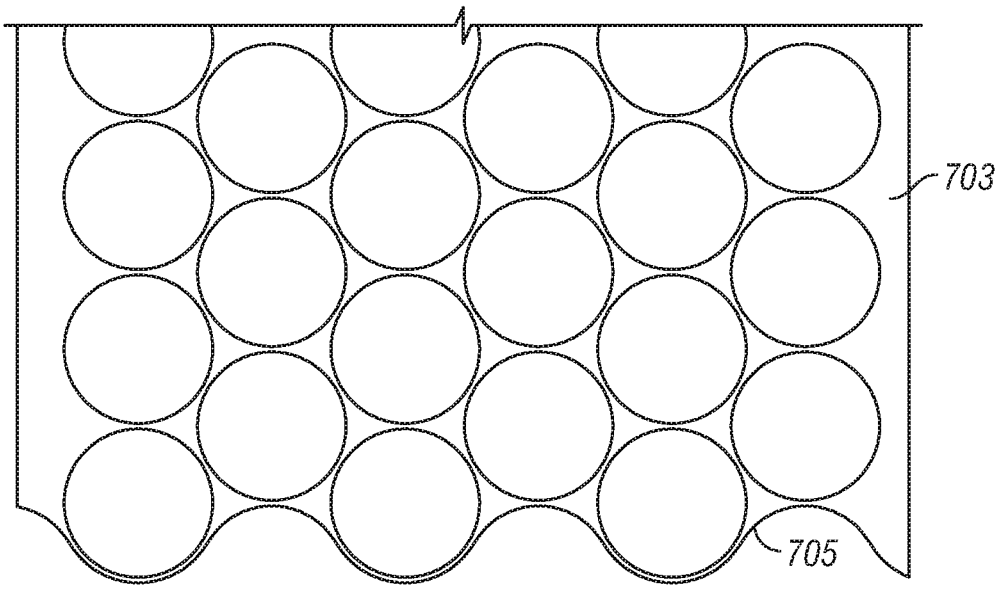
FIG. 7C illustrates a curvilinear scalloped edge of a separated crown body sheet in accordance with an embodiment.

FIG. 7C illustrates a preferred embodiment in which the scalloped edge is curvilinear. Advantageously, as illustrated, the curvilinear edge follows the same curvature of the crown body blanks. A curvilinear scalloped edge is ideal for reducing the amount of wasted material between cut sheets. Compared to the angular scalloped edge 704 depicted in FIG. 7B, a curvilinear edge 705 does not require a gap or the destruction of production row of blanks.

Crown Body Manufacturing Process

Figure 8A:
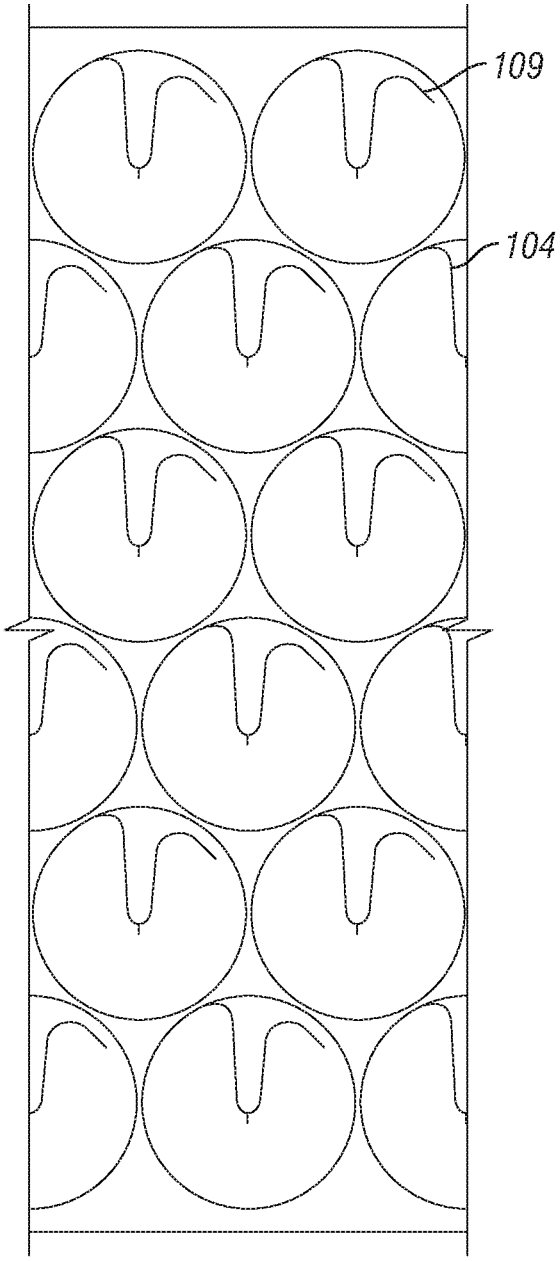
FIG. 8A illustrates a manufacturing step for forming one or more score lines on a crown body sheet in accordance with an embodiment.
Figure 8B:
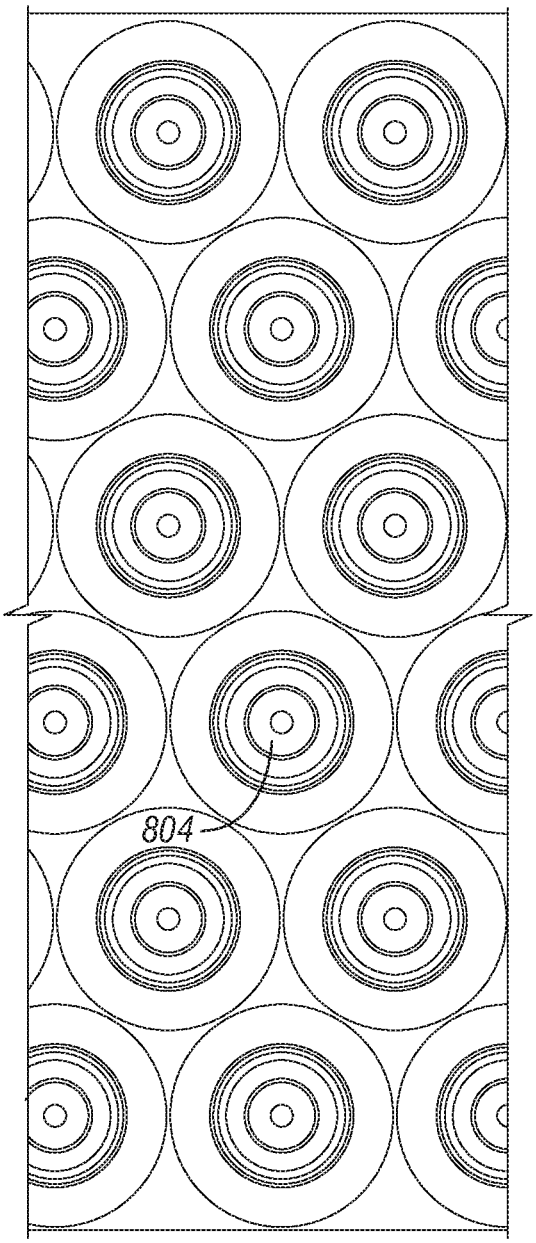
FIG. 8B illustrates a manufacturing step for forming one or more rivets and recesses on a crown body sheet in accordance with an embodiment.
Figure 8C:
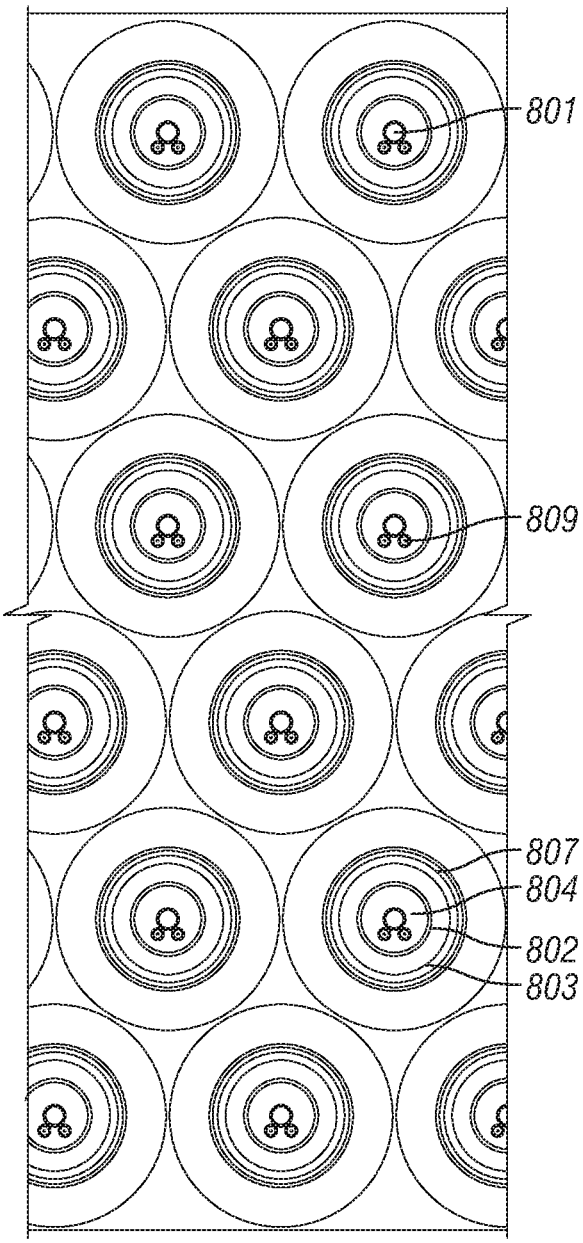
FIG. 8C illustrates a manufacturing step for forming one or more dimples on a crown body sheet in accordance with an embodiment.

FIGS. 8A-8C provide top view illustrations of exemplary steps in the disclosed manufacturing technique for manufacturing the crown bodies. However, as mentioned before, a greater or fewer number of steps may be included, or specific features created with certain steps may be provided by different steps in the process, without departing form the broad spirit and scope of the disclosed principles. FIG. 8A illustrates a manufacturing step for forming one or more score lines on a crown body sheet in accordance with an embodiment. In order to form score lines for one or more crown bodies, as well as other features described with respect to subsequent figures, progressive stamping may be used (e.g., using a multi-stage mechanized die press).

Progressive stamping is a metalworking method that can encompass punching, coining, bending, and several other ways of modifying metal raw material, combined with an automatic feeding system. The feeding system pushes a strip of metal through all of the stations of one or more progressive stamping dies. Each station performs one or more operations until a finished part is made. The final station is a cutoff operation, which separates the finished part from the carrying web. The carrying web, along with metal that is punched away in previous operations, is treated as scrap metal. Both are cut away, knocked down (or out of the dies) and then ejected from the die set, and in mass production are often transferred to scrap bins via underground scrap material conveyor belts.

One or more progressive stamping dies are placed into a reciprocating stamping press. As the press moves up, the top die moves with it, which allows the material to feed. When the press moves down, the die closes and performs the stamping operation. With each stroke of the press, a completed part is removed from the die. Since additional work is done in each "station" or "stage" of the die, it is important that the strip be advanced very precisely so that it aligns within a few thousandths of an inch as it moves from station to station. Bullet- or conical-shaped "pilots" may be used improve alignment beyond what is provided by the servo feeding mechanism.

Each die may be made of tool steel to withstand the high shock loading involved, retain the necessary sharp cutting edge, and resist the abrasive forces involved. In certain preferred embodiments, groups of die stamps may be configured to work together. For example, a first group of six stamps may stamp the sheet material while a second group of six stamps representing a subsequent die stage stamp the sheet material simultaneously. Such grouping allows one group to provide one part of the crown body stamping process, while another provides a later part of the crown body stamping process. Of course, a greater or lesser number of stamps may be so grouped, or only a single grouping of all stamps may be provided during the stamping of the crown body.

Returning to the manufacturing step depicted by FIG. 8A, the crown body strip may be scored to form one or more score lines 104 on one or more crown bodies. Note that in the formation of the score lines 104, the lines may comprise a first scoring line extending from the central, or even on off-center portion, of what will be the rivet area of the final formed crown, to towards to the lower edge of what will eventually be the skirt area of the crown in a continuous radial direction. The score lines 104 may also comprise a second scoring line having an upper radial segment extending from that eventual rivet area towards to the eventual skirt area along a radial axis, where this second score line includes a lower annular segment extending circumferentially along the skirt area in an annular direction and extending from a terminus of the upper radial segment, the lower annular segment defined in a second horizontal plane equidistant to the first horizontal plane associated with the lower edge of the skirt. Still further, in some embodiments, one or more additional score lines may be formed extending slightly in the opposite direction from the first and second score lines. Specifically, such additional score line(s) may be included to assist in the "cracking" of the crown body material during an opening operation of the completed crown when mounted on a container.

In the same step, or in a prior preliminary step, of forming the score lines 104. a blanking die may also be used to trim the outline of a crown. It should be noted, however, that the order of steps performed in the illustrated embodiment disclosed herein are merely exemplary, and therefore scoring or other steps in the disclosed process may occur in different order without deviating from the scope of the disclosed principles.

FIG. 8B illustrates a manufacturing step for forming one or more rivets (shown as 801 in FIG. 8C) and recesses 804 on a crown body sheet in accordance with an embodiment. In some embodiments, a multi-step process may be used to first pre-form a rivet before later crimping the rivet to produce the cross-sectional shape illustrated in FIG. 4B. In such an exemplary embodiment, the rivet is raised above the sheet material surface to allow combination with the pull ring and tab assembly later in the manufacturing process; however, other rivet formations may also be provided with the disclosed principles.

In addition to rivet formation, the same or a subsequent die may be configured to form corrugated ridges (402, 407) and recesses (404, 405), as seen in FIGS. 4A, 4B and 4C, in order to provide corrugation for increased strength across the surface of the crown body, such as in crowns manufactured at a reduced gauge or thickness as compared to conventional crowns. Such an embossing step may also create a recessed seat in which an attached pull ring and tab assembly may be nested once joined with the crown body.

FIG. 8C illustrates a manufacturing step for forming one or more dimples 809 on a crown body sheet in accordance with an embodiment. Ridges (802, 803) and slopes 807, which form corrugated recesses 804, may be formed in the same or previous steps (e.g., the step shown in FIG. 8B). In addition to dimple formation, the same or subsequent stage may stamp the sheet material in order to trim the crown body to facilitate later assembly with the pull ring and tab assembly. Such stamping can be used to substantially remove or free the crown body from the sheet material, leaving only small tabs keeping the two together until the assembly stage with the pull ring and tab portion of the crown.

Pull Ring and Tab Assembly Manufacturing Process

FIGS. 9A-9I provide top view illustrations of exemplary steps in the disclosed manufacturing technique for manufacturing the pull ring and tab assemblies. However, as before, a greater or fewer number of steps may be included, or specific features created with certain steps may be provided by different steps in the process, without departing form the broad spirit and scope of the disclosed principles. In one embodiment of the pull ring and tab assembly manufacturing process, a progressive stamping process is used to form the shape and structural features of a pull ring and tab assembly as described above with respect to FIGS. 5A and 5B. In each stage depicted, one or more alignment guides 901 may be used for precision alignment of the die punch to the workpiece and the carrying web.

Figures 9A, 9B, 9C:
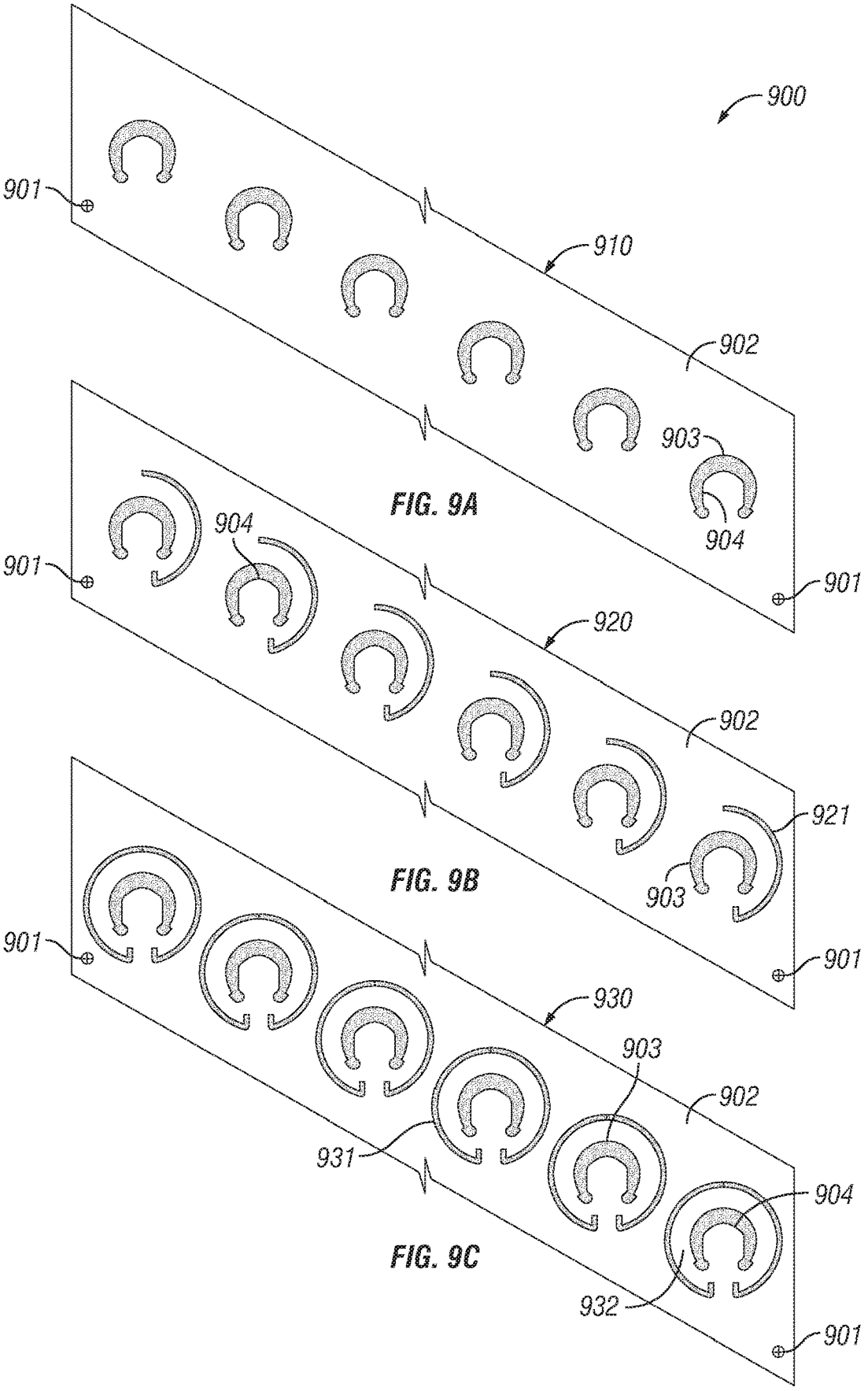
FIG. 9A illustrates a manufacturing step for forming the outer edges of one or more pull tabs on a pull ring and tab assembly sheet in accordance with an embodiment.
FIG. 9B illustrates a manufacturing step for forming the right outer edges of one or more pull rings on a pull ring and tab assembly sheet in accordance with an embodiment.
FIG. 9C illustrates a manufacturing step for forming the left outer edges of one or more pull rings on a pull ring and tab assembly sheet in accordance with an embodiment.

FIG. 9A illustrates a manufacturing step 910 for forming the outer edges 903 of one or more pull tabs on a pull ring and tab assembly sheet in accordance with an embodiment. During the manufacturing process step illustrated by FIG. 9A, the internal diameter or surface of the pull ring 904 of the pull ring and tab section is formed. Such internal formation and scoring for the internal outline of the pull ring may be used to not only remove desired material from the internal area of the pull ring, but such internal area may also be rolled or otherwise deformed to provide a smooth internal ring surface that is free of sharp edges.

The pull ring and tab section may be produced from a coil of appropriate material, such as metal or plastic, or may be produced from cut sheets of material similar to that used for the crown body production. Of course, no limitation to the source material, or its shape, is intended or should be implied and the disclosed production equipment and process may advantageously be employed with any type of appropriate material(s).

FIG. 9B illustrates a manufacturing step 920 for forming the right outer edges 921 of one or more pull rings on a pull ring and tab assembly sheet 902 in accordance with an embodiment.

FIG. 9C illustrates a manufacturing step 930 for trimming the left outer edges of one or more pull rings on a pull ring and tab assembly sheet 902 such that the outer ring diameter 931 is formed. At such a stage, the surface area for a pull ring 932 is successfully formed in the workpiece such that its edges may be stamped, folded, and curled in later stages.

Figure 9D:
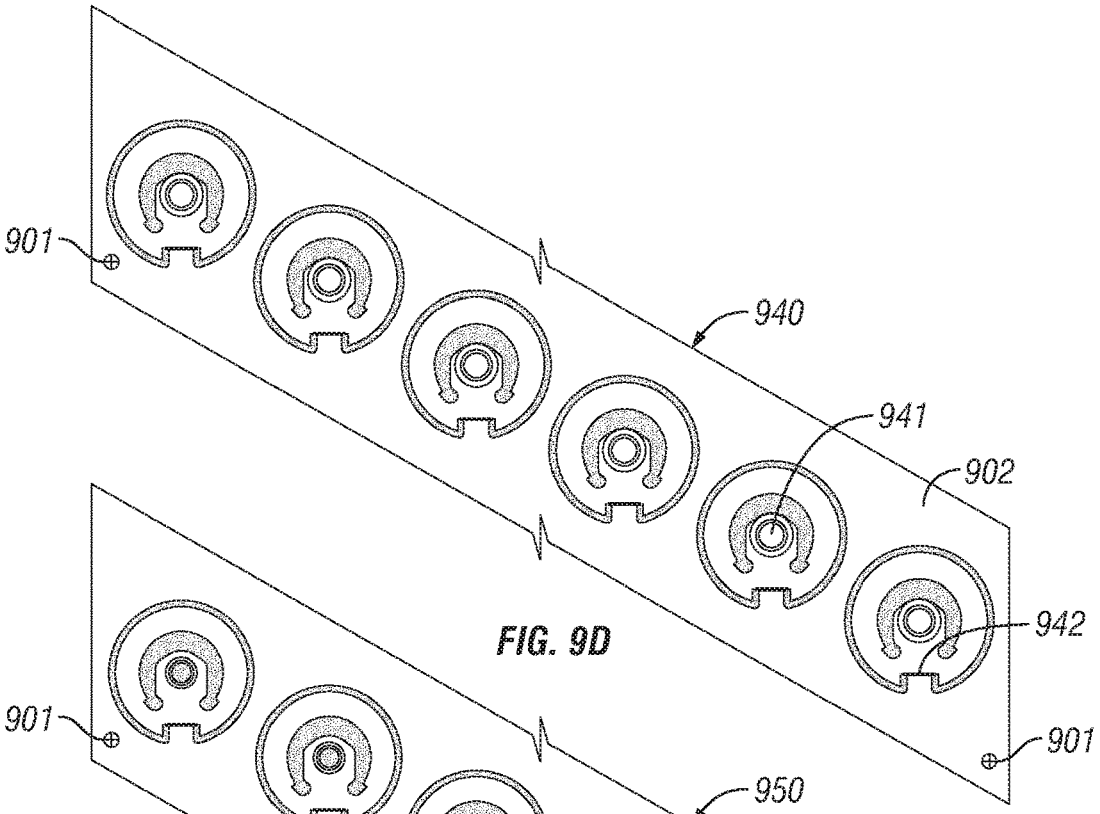
FIG. 9D illustrates a manufacturing step for forming rivet recesses on one or more pull tabs on a pull ring and tab assembly sheet in accordance with an embodiment.

FIG. 9D illustrates a manufacturing step 940 for forming rivet recesses 941 on one or more pull tabs 904 on a pull ring and tab assembly sheet 902 in accordance with an embodiment. This step also encompasses embossing of the tab portion 904 of the pull ring and tab section of the disclosed crown. The embossing may occur from the top of the tab portion, but in other embodiments the embossing may be provided from the bottom, if desired. Such embossing may be descriptive so as to provide instruction for later use of a finished crown, and it may also provide a depressed surface for location of the rivet discussed above during the combination of the crown body with the pull ring and tab section. Of course, other types of embossing, or none at all, may also be provided. Additionally, the connection point 942 for the workpiece to the carrying web may be punched or scored such that only small tabs continue to hold the pull ring and tab portion to the material in order to facilitate later separation from the carrying web and assembly of the ring pull crown.

Figure 9E:
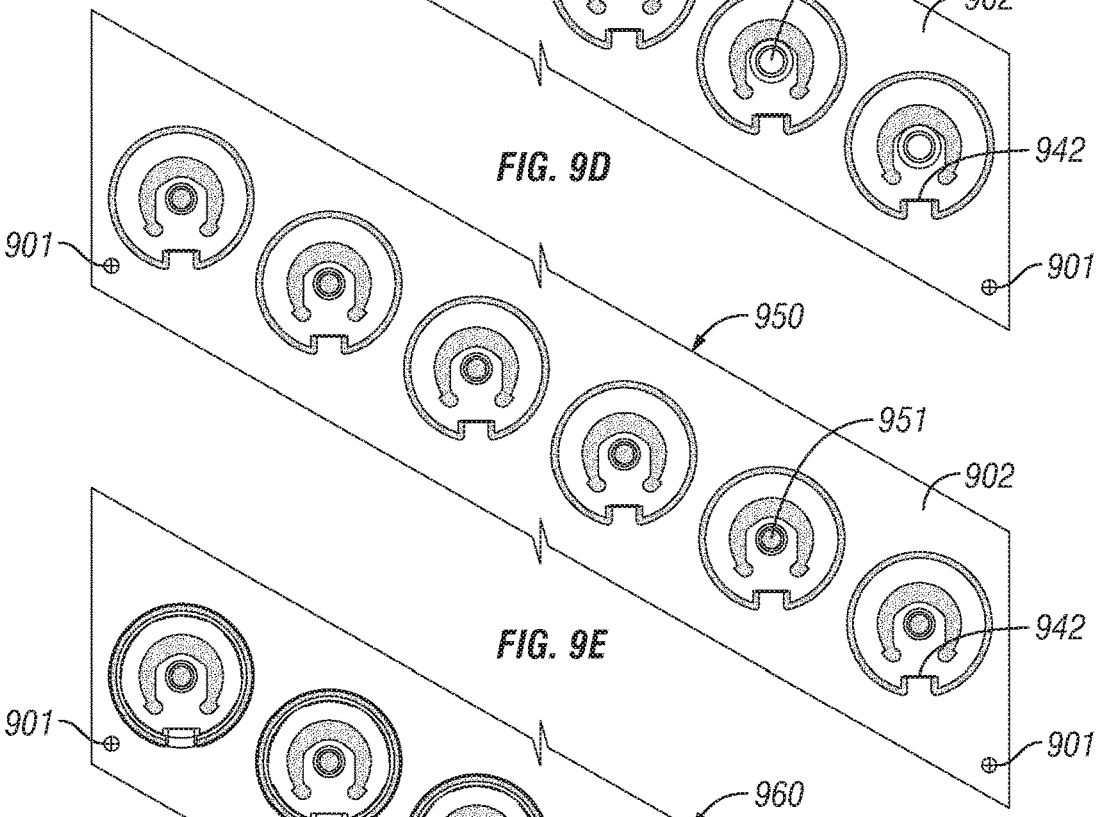
FIG. 9E illustrates a manufacturing step for forming rivet holes on one or more pull tabs on a pull ring and tab assembly sheet in accordance with an embodiment.

FIG. 9E illustrates a manufacturing step 950 for forming rivet holes 951 on one or more pull tabs 904 on a pull ring and tab assembly sheet 902 in accordance with an embodiment. Such a step provides for the punching of a rivet hole punched/stamped into the tab portion 904 of the pull ring and tab assembly. The rivet hole 951 facilitates the combination of the crown body and the pull ring and tab section at a later stage in the manufacturing process. It should be noted that formation of such a rivet may occur earlier in the pull ring and tab formation process, and no limitation to any particular order is intended.

Figure 9F:
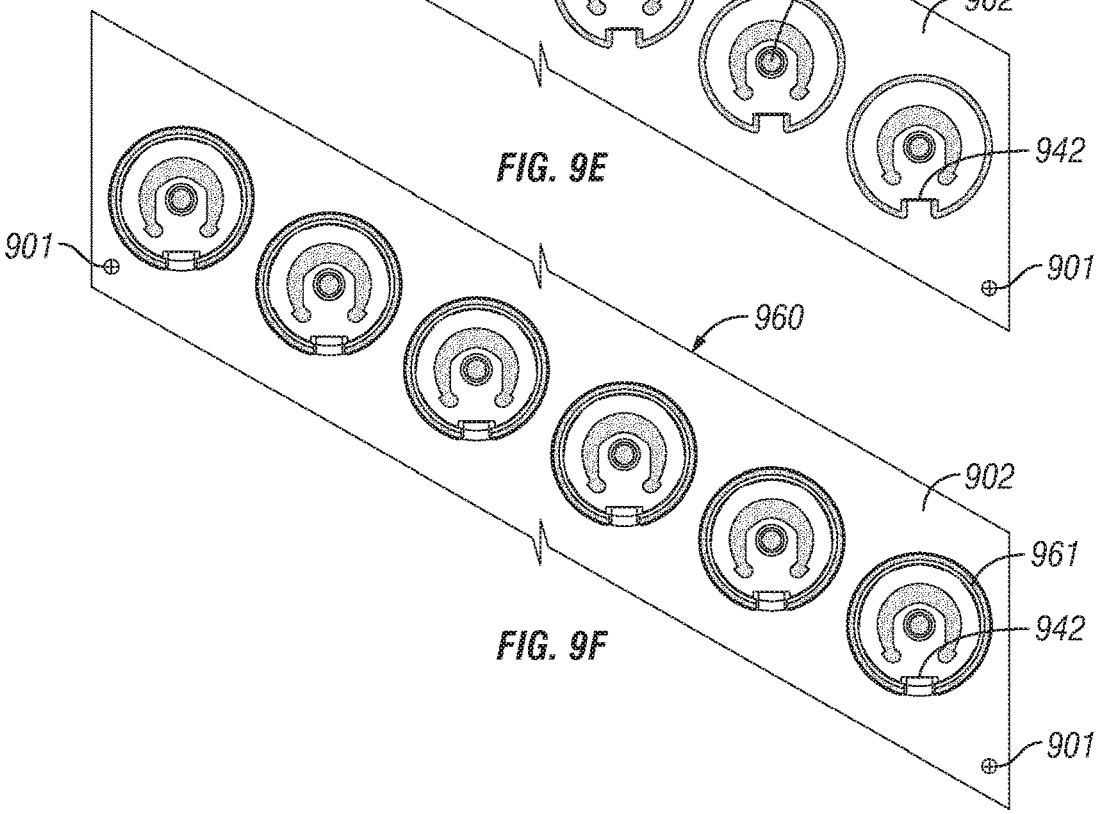
FIG. 9F illustrates a manufacturing step for creating a fold line on the outer edges of one or more pull rings on a pull ring and tab assembly sheet in accordance with an embodiment.

FIG. 9F illustrates a manufacturing step 960 for creating a fold line 961 on the outer edges of one or more pull rings 932 on a pull ring and tab assembly sheet 902 in accordance with an embodiment. In such a step, the outer edge 961 of the pull ring 932 is stamped or creased in preparation for folding and eventually curling of the outer edge under the ring (see, e.g., curled edge 503 of FIG. 5B).

Figures 9G, 9H, 9I:
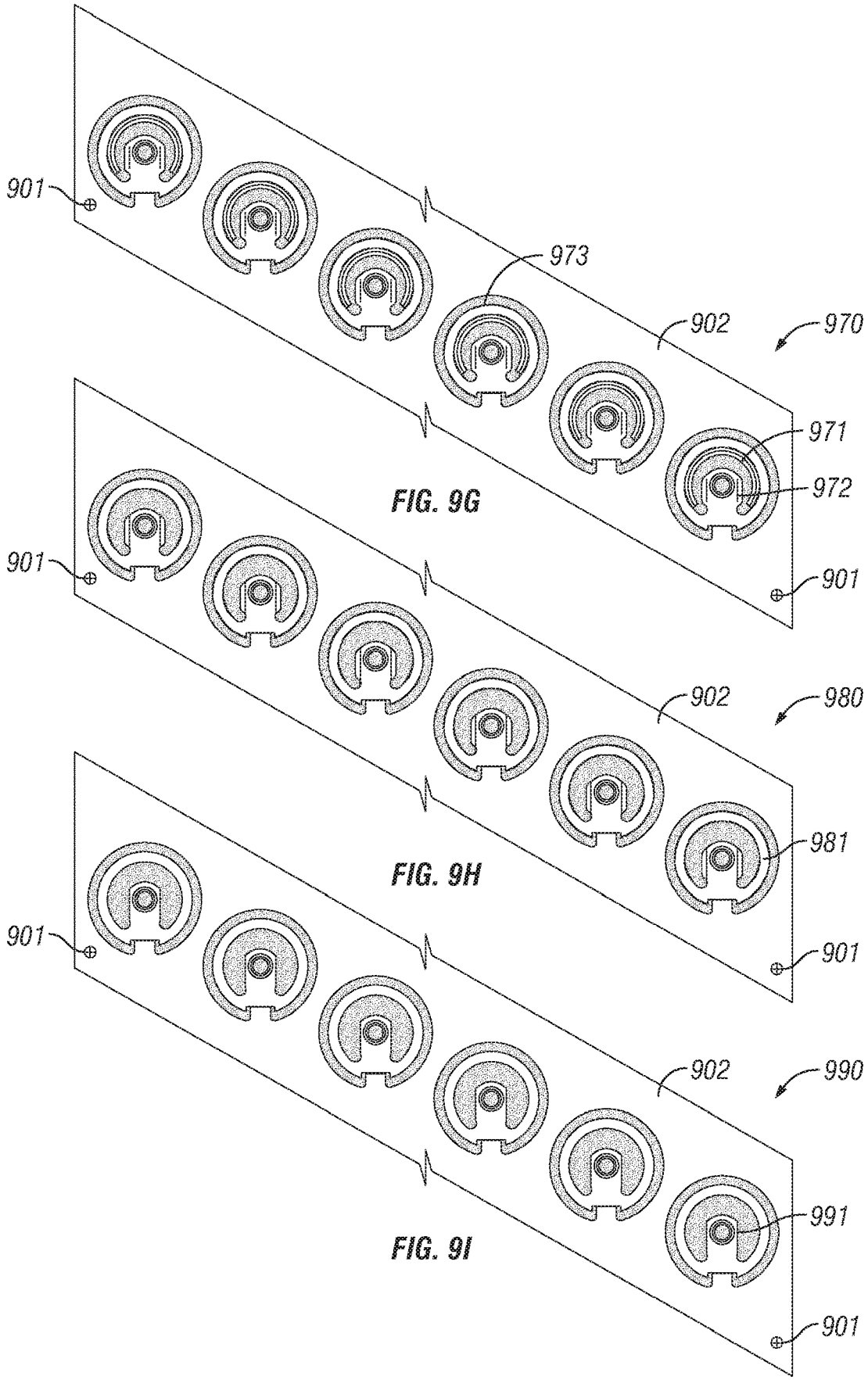
FIG. 9G illustrates a manufacturing step, on a pull ring and tab assembly sheet, for simultaneously rolling the outer edges of one or more pull rings, creating a fold line on the inner edges of one or more pull rings, and creating fold lines on the wings of one or more pull tabs in accordance with an embodiment.
FIG. 9H illustrates a manufacturing step, on a pull ring and tab assembly sheet, for simultaneously rolling the inner edges of a pull ring and rolling the wings of one or more pull tabs in accordance with an embodiment.
FIG. 9I illustrates a manufacturing step for smoothing any rolled edges on a pull ring and tab assembly sheet in accordance with an embodiment.

FIG. 9G illustrates a manufacturing step 970, on a pull ring and tab assembly sheet 902, for simultaneously folding or rolling the outer edges 961 of one or more pull rings 932, creating a fold line 971 on the inner edges of one or more pull rings, and creating fold lines 972 on the wings of one or more pull tabs in accordance with an embodiment.

FIG. 9H illustrates a manufacturing step 980, on a pull ring and tab assembly sheet 902, for simultaneously rolling the inner edges of a pull ring along the fold line 971 and rolling the wings 972 of one or more pull tabs in accordance with an embodiment.

FIG. 9I illustrates a manufacturing step 990 for smoothing any rolled edges on a pull ring and tab assembly sheet in accordance with an embodiment. The smoothing may be provided by simply flattening the ring and tab assemblies further, or by one or more precise steps provided by one or more dies.

In alternative embodiments, a pull ring and tab assembly may be formed from a plastic material using plastic forming techniques, such as: injection molding, blow molding, or compression molding. For example, in injection molding, melted plastic, for example resin plastic, may be forced into a mold cavity. Once cooled, the mold is removed. Thus, for plastic embodiments, rather than employing traditional sheet metal dies and punches, the disclosed principles may include plastic injection equipment or other plastic formation equipment in place of the die and punch equipment illustrated herein. In such embodiments, the plastic formation equipment would substitute the die and punch equipment described below so that the non-metal assemblies may be manufactured in their place. Moreover, the disclosed principles include those embodiments where the pull ring and tab assemblies are preformed in a separate process, and such preformed assemblies are fed into the disclosed manufacturing process for attachment to the crown bodies.

Final Assembly and Finishing

Figure 10:
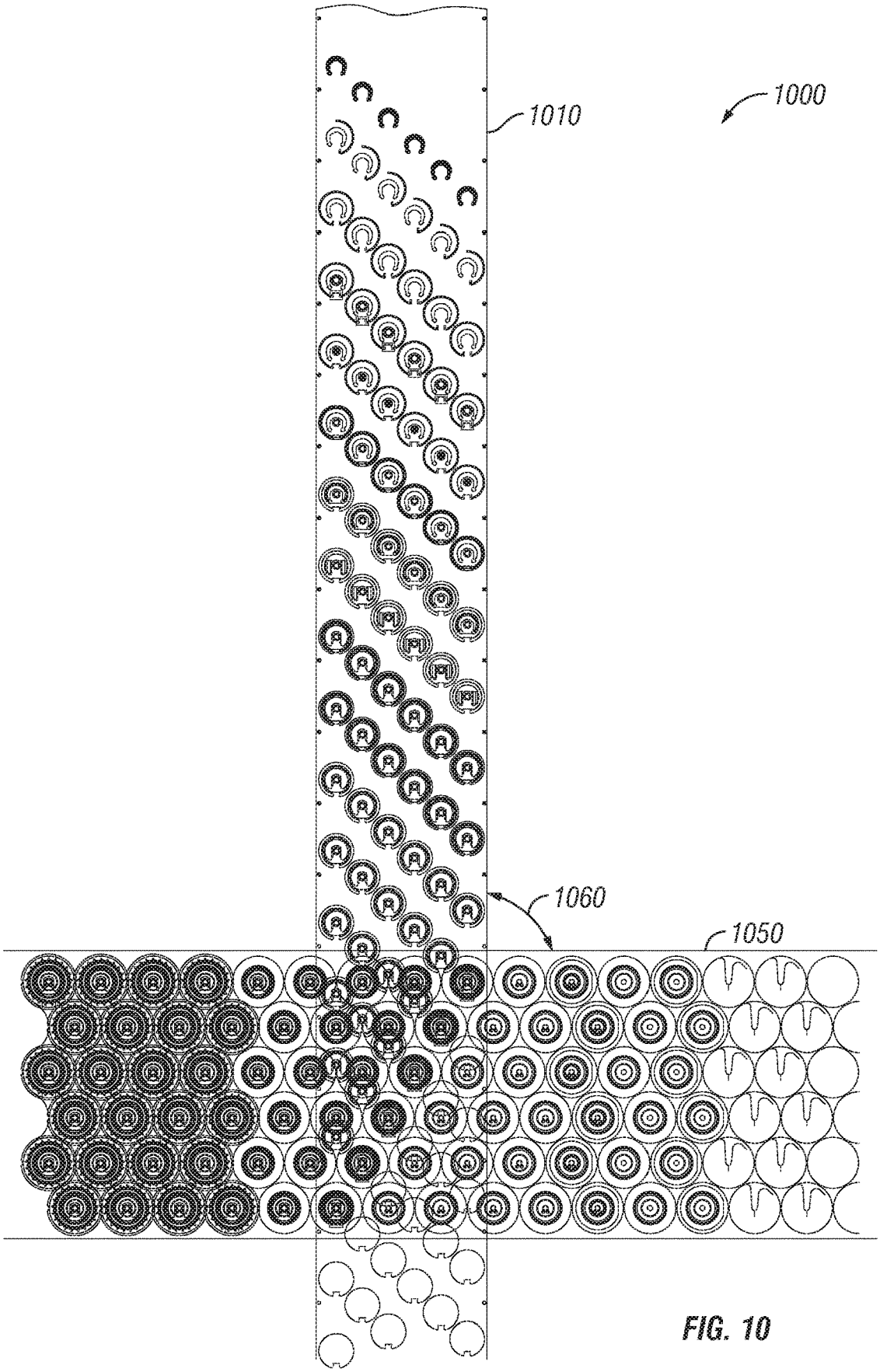
FIG. 10 illustrates the various stages of the respective manufacturing processes for forming a crown body and a pull ring and tab assembly in accordance with an embodiment.

FIG. 10 illustrates the various stages of the respective manufacturing processes, which are described above, for forming a crown body and a pull ring and tab assembly in accordance with an embodiment. In general, any suitable method may be used for combining the outputs of the two parallel manufacturing processes (1010, 1050) for crown bodies and pull ring and tab assemblies. However, in a preferred embodiment shown in FIG. 10, the two parallel process may be positioned at an angle 1060 (e.g., sixty or ninety degrees) with respect to the other such that a single diagonal row of attachment/compression dies may be used to combine the outputs of the two lines.

In the illustrated embodiment, the pull ring and tab assembly manufacturing process 1010 progresses from north to south. Each formative stage for the pull ring and tab assembly is arranged in a diagonal row. Many of the conventional manufacturing techniques for forming pull tabs use different patterns for arranging the pieceworks within the carrying web. Compared with conventional pull tabs, the size and shape of a piecework for a pull ring and tab assembly is generally larger and more circular. Existing methods of attachment, which were design for a small pull tab, will not work for the larger pull ring and tab assemblies. Thus, a different pattern is needed for arranging pull ring and tab assemblies in such a way that minimizes carrying web scrap, is scalable depending on the number of piecework dies used for each die stage (e.g., 2, 3, 4, 6, or 8), and is oriented in such a way that a completed pull ring and tab assembly may be efficiently attached to a corresponding crown body. As shown in FIG. 10, arranging the dies stages (and corresponding pieceworks) in diagonal rows permits two parallel, non-collinear processes to intersect and yet allow the combination of the corresponding outputs using a single die stage.

Returning to the arrangement of processes illustrated by FIG. 10, the crown body manufacturing process progresses from east to west, and the processes meet a location where the ring and tab assemblies are mounted on and attached to the corresponding crown bodies. The precise angle of the diagonal may vary in degree; however, the angle of the diagonals used for the pull ring and tab assembly process would preferably match the angle of the diagonals used for the crown body process. In a preferred embodiment in which the blanks of the crown body sheet are arranged using a hexagonal pattern (for space saving reasons as discussed above), the corresponding diagonal stages of the pull ring and tab assembly sheet 1010 should form a sixty degree angle with the length of the sheet 1010. In general, the array of pull ring and tab assemblies should match the circle-packing arrangement used in the crown body strip such that each pull ring and tab assembly, when overlaid over a corresponding crown body strip, is vertically aligned with a corresponding crown body.

One advantage of using a diagonal stamping process for combining the pull ring and tab assemblies and crown bodies is that a simpler reciprocating system may be used to drive the attachment die stage. An entire diagonal row of pull ring and tab assemblies may be joined with an entire diagonal row of crown bodies in a single compressive motion. This simplifies the timing and alignment of the two parallel processes in that each process advances one entire stage between successive compressions. This unique process provides not only an advantage in saving time as an entire diagonal row of pieceworks may be combined in a single operation, but also an advantage in saving space as the beneficial arrangement of crown bodies, and thus the corresponding angular alignment of pull ring and tab assemblies, disclosed herein allows the smallest die press for combining the two pieceworks for the given number of crown bodies and ring and tab assemblies being combined.

Figure 11:
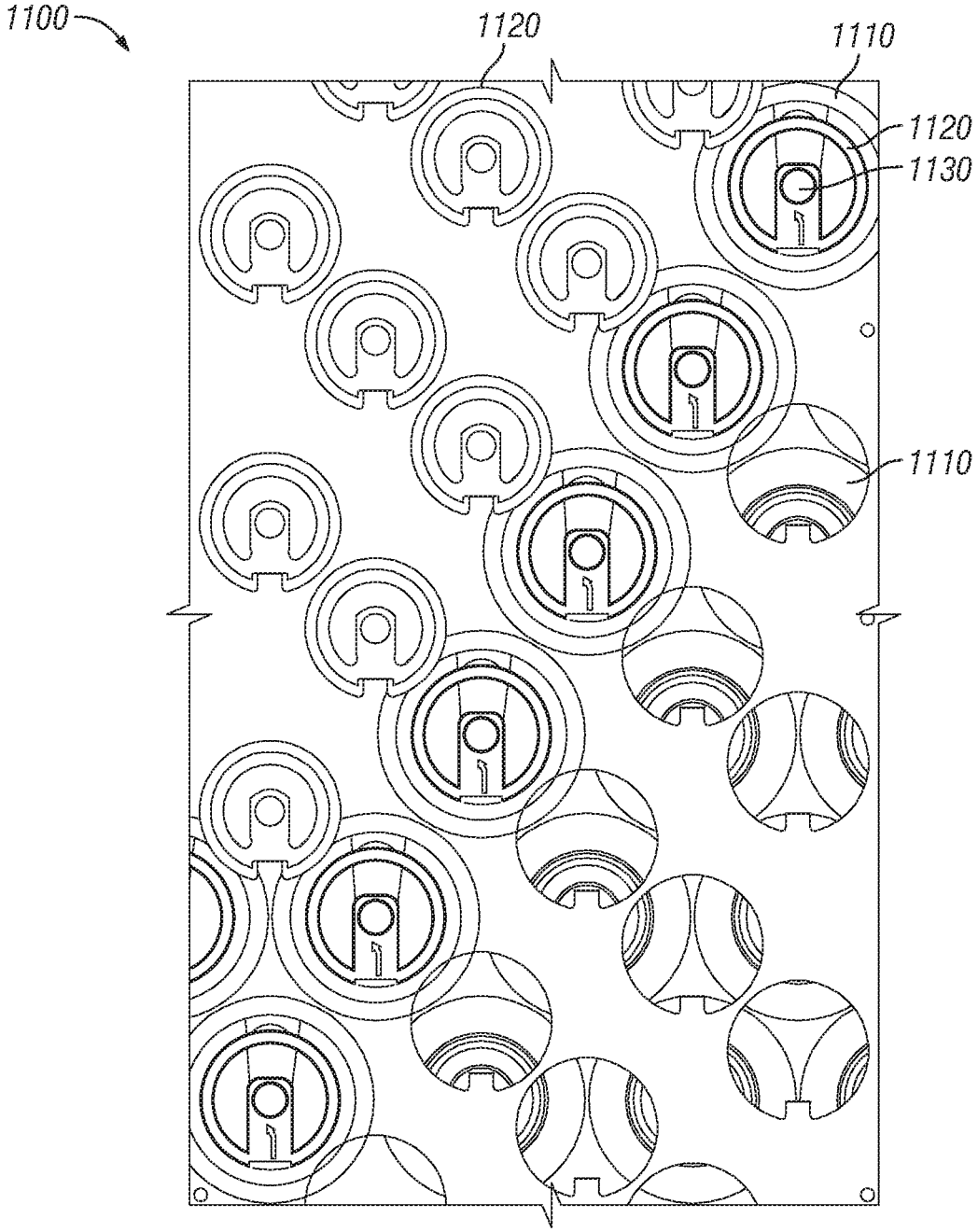
FIG. 11 illustrates a manufacturing step for forming a ring pull crown by combining a crown body with a corresponding pull ring and tab assembly in accordance with an embodiment.

FIG. 11 illustrates a manufacturing step for forming a ring pull crown by combining crown bodies 1110 with corresponding pull ring and tab assemblies 1120 in accordance with an embodiment. In such a step, the material having the pull ring and tab assemblies 1120 may be moved directly over the material having the crown bodies 1110. As the pull ring and tab assemblies 1120 are positioned over the crown bodies 1110, the rivet 1130 stamped in the crown bodies 1110 and the rivet holes punched in the pull ring and tab assemblies 1120 are aligned. One or more distinct stamps may be used to simultaneously combine multiple pull ring and tab assemblies 1120 with corresponding crown bodies 1110 once the corresponding portions of each crown are aligned. In certain preferred embodiments, six stamps may be used for any given crown stage; however, a greater or lesser number of stamps could also be employed. As the pull ring and tab assemblies 1120 are combined with the crown bodies 1110 using the rivets 1130 and rivet holes, the remaining waste material from the pull ring and tab construction may be expelled from the manufacturing equipment disclosed herein. In such embodiments, the combined pull ring and tab assemblies 1120 and crown bodies 1110 continue on the crown body sheet material as completed, assembled crowns.

Figure 12:
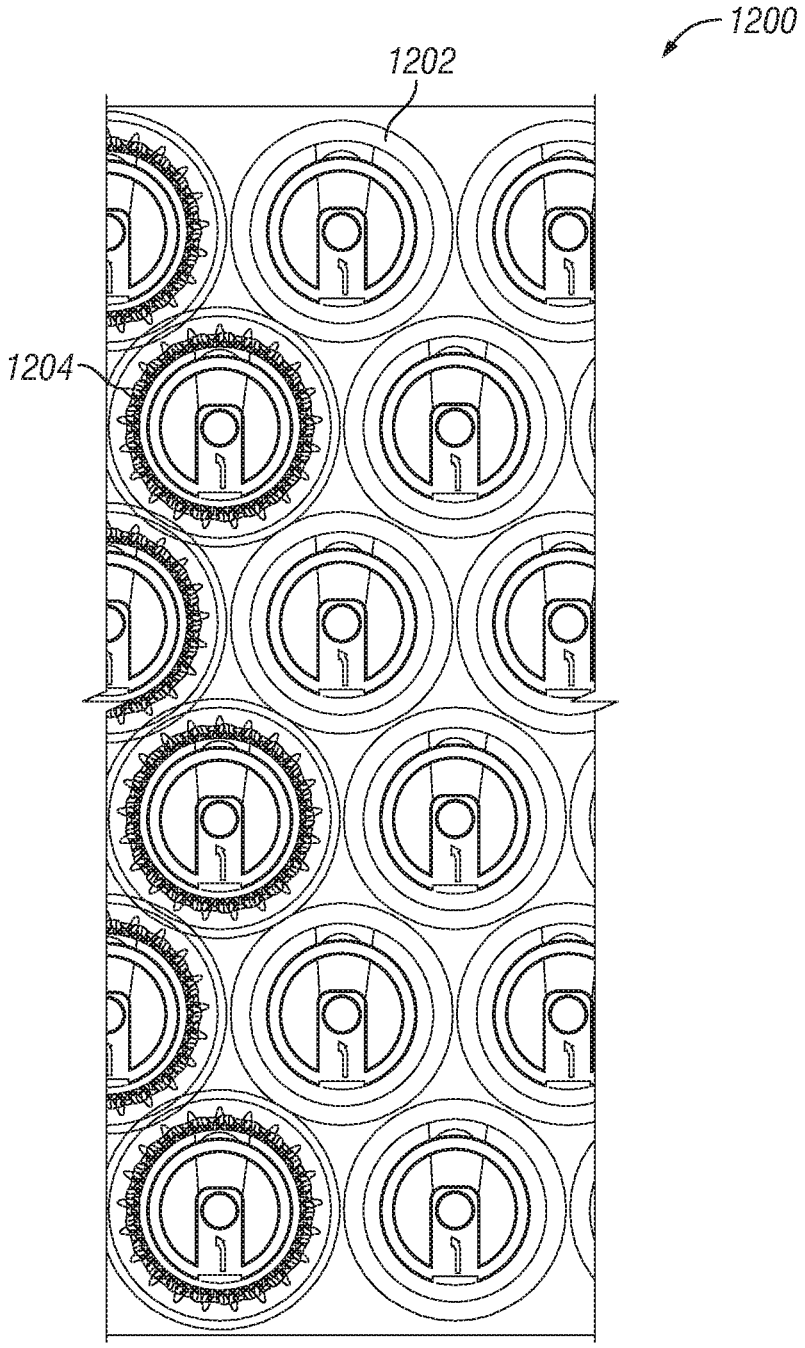
FIG. 12 illustrates a manufacturing step for corrugating the outer edge of a ring pull crown and separating it from the crown body sheet in accordance with an embodiment.

Once these two portions are combined to form single, completed crown 1202 (such as the crown illustrated in FIG. 1A), another set of stamps is used to corrugate the assembled crowns 1202. FIG. 12 illustrates a manufacturing step for corrugating the outer edge (i.e., "skirt") of an assembled ring pull crown 1202 in accordance with an embodiment.

During the corrugation, the stamps may also provide a desired curvature, as well as flutes if desired, to the skirt area of the crowns to create a skirt configured to be received around an opening, such as the top of a bottle selected to receive a completed crown constructed in accordance with the disclosed principles. In the illustrated embodiment, skirts with flutes are formed in the finished crown assemblies 1204, for example, for use in typical bottle cap applications. However, in other embodiments, the skirts may be free of any flutes and may instead be given a smooth surface.

Additionally, the same stamps may be used to form the skirt areas of the crowns 1204 may also be used to punch the completed crowns 1204 from the sheet material. In other embodiments, a separate set of stamps may instead be used to separate the completed crowns 1204 from their sheet material. Further, in some embodiments, bottom portions of the set of stamps used to remove the assembled crowns from the sheet material may also provide a liner material to an underside of the crowns during creation of the skirt. Alternatively, the liners may be added in a subsequent process with subsequent equipment.

Manufacturing Equipment

Figure 13A:
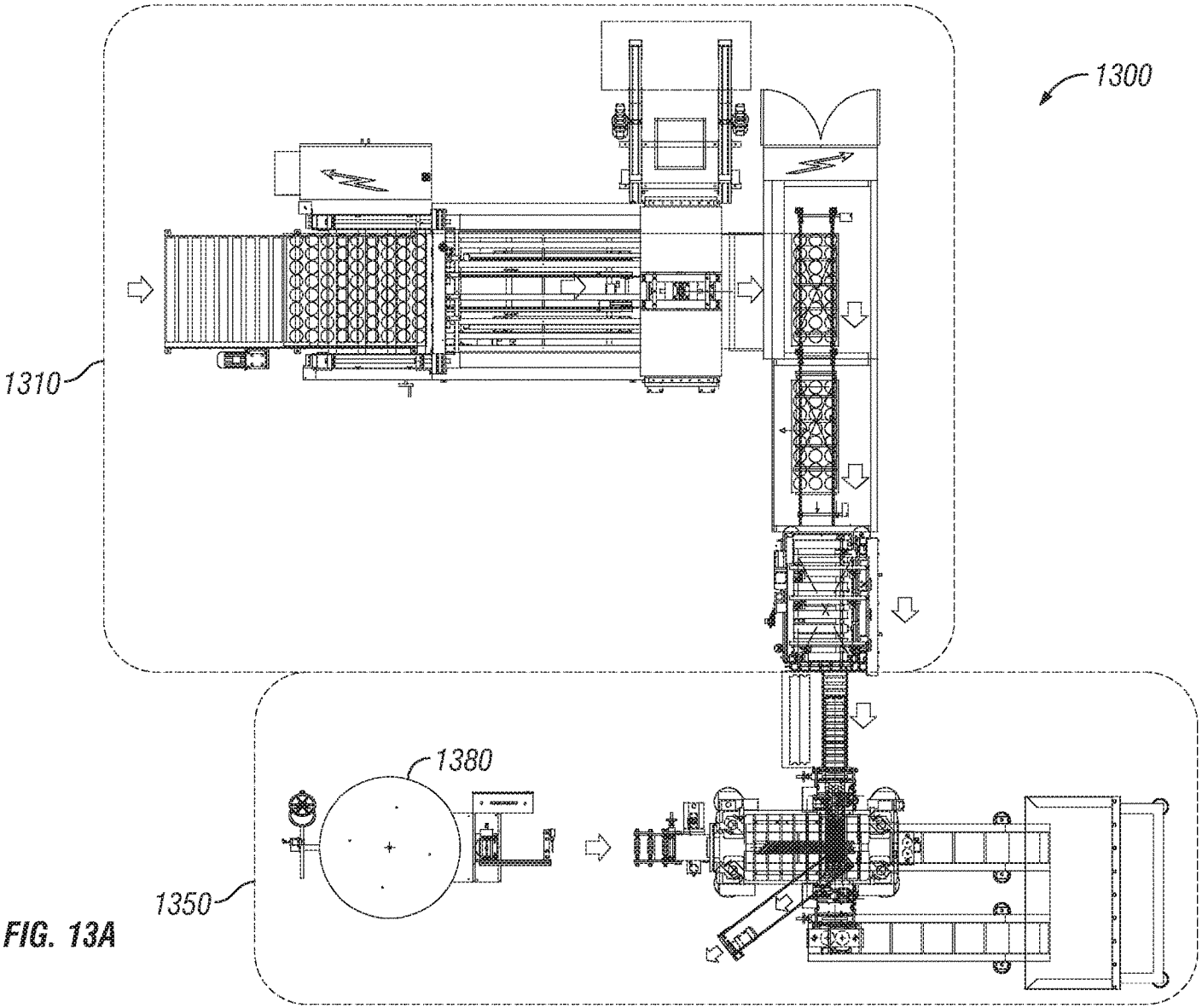
FIG. 13A illustrates a system for manufacturing ring pull crowns in accordance with an embodiment.

FIG. 13A illustrates a system 1300 for manufacturing ring pull crowns in accordance with an embodiment. The exemplary system 1300 comprises pre-staging automation equipment 1310 for feeding parallel-stage die press equipment 1350 with a continuous sequence of crown body strips. The two sub-systems 1310 and 1350 are described in further detail below with respect to FIGS. 13B and 13C.

Figure 13B:
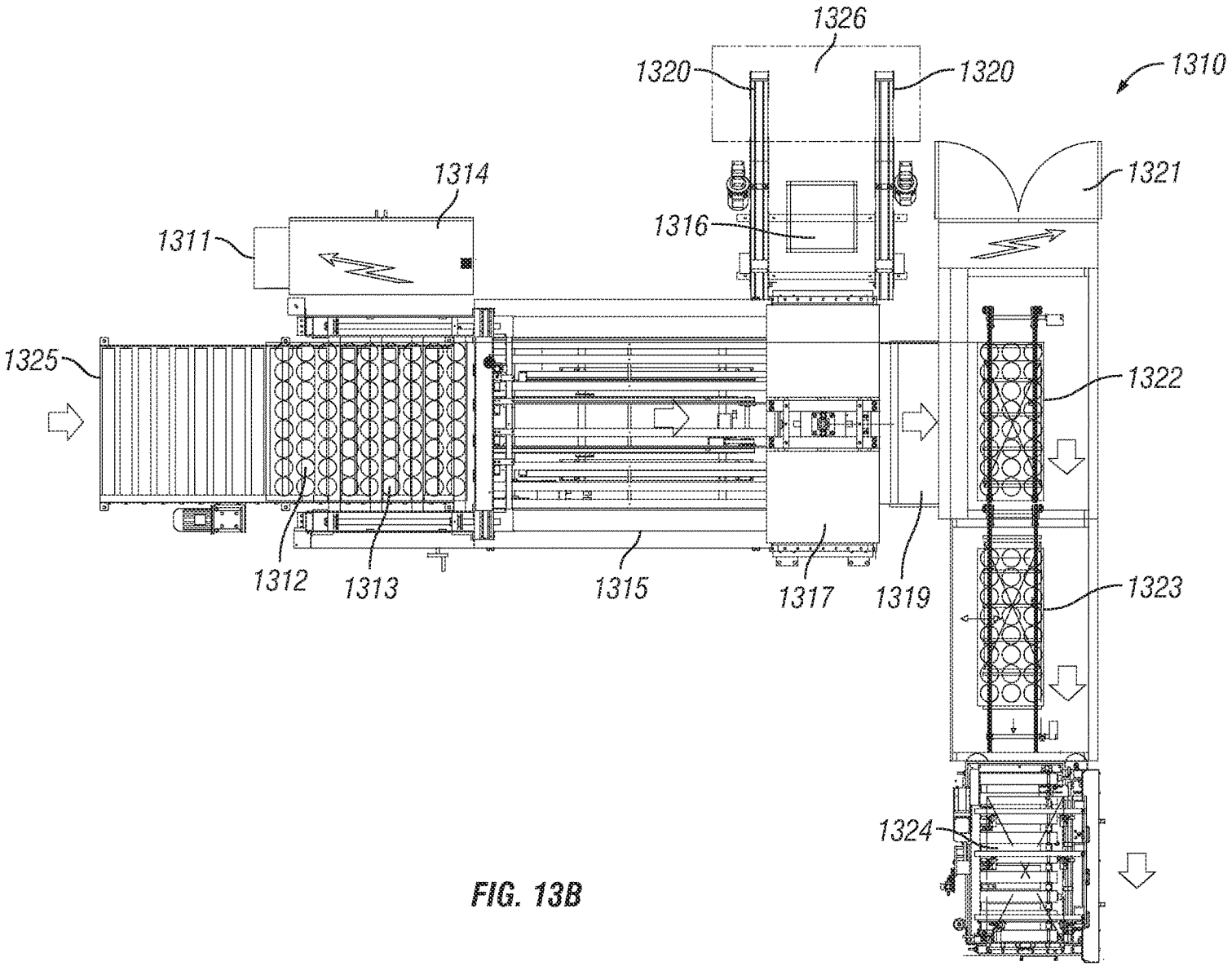
FIG. 13B illustrates a machine for forming and feeding one or more crown body strips from a printed crown body sheet in accordance with an embodiment.

In accordance with one embodiment, FIG. 13B illustrates equipment 1310 for cutting a printed crown body sheet 1313 into individual crown body strips and aligning and outputting the strips in a continuous end-to-end feed for use with a conveyor system. The equipment 1310 includes a hydraulic guillotine 1317, a strip stacker 1322, a buffer 1323, and a lifting table/non-stop feeder 1324. The equipment 1310 may also have an electrical cabinet 1314 that is cooled by AC unit 1311.

The hydraulic guillotine 1317, which may be powered by a hydraulic power unit 1316, is fed by an automated sheet feeder 1315 connected to a driven roller platform 1312. Printed crown body sheets 700 are deposited on the driven roller platform 1312 by a machine operator or by another automated process. The automated sheet feeder 1315 buffers a crown sheet 700 before it is fed synchronously into the hydraulic guillotine 1317. The hydraulic guillotine 1317, or a similar device, may also be responsible for forming the scalloped edges on each crown body strip. Excess scrap from the cutting and scalloping process would be deposited in a scrap bin for trims 1326 conveyed by magnetic scrap removals 1320. The cut strips exit the guillotine 1317 and are moved by a magnet belt 1319 to strip stacker 1322, which stacks the strips. One the stacked strips reach a predetermined number, the stack is moved down the line to a buffering station 1323 before being eventual fed into the next subsystem via the lifting table/non-stop feeder 1324.

Figure 13C:
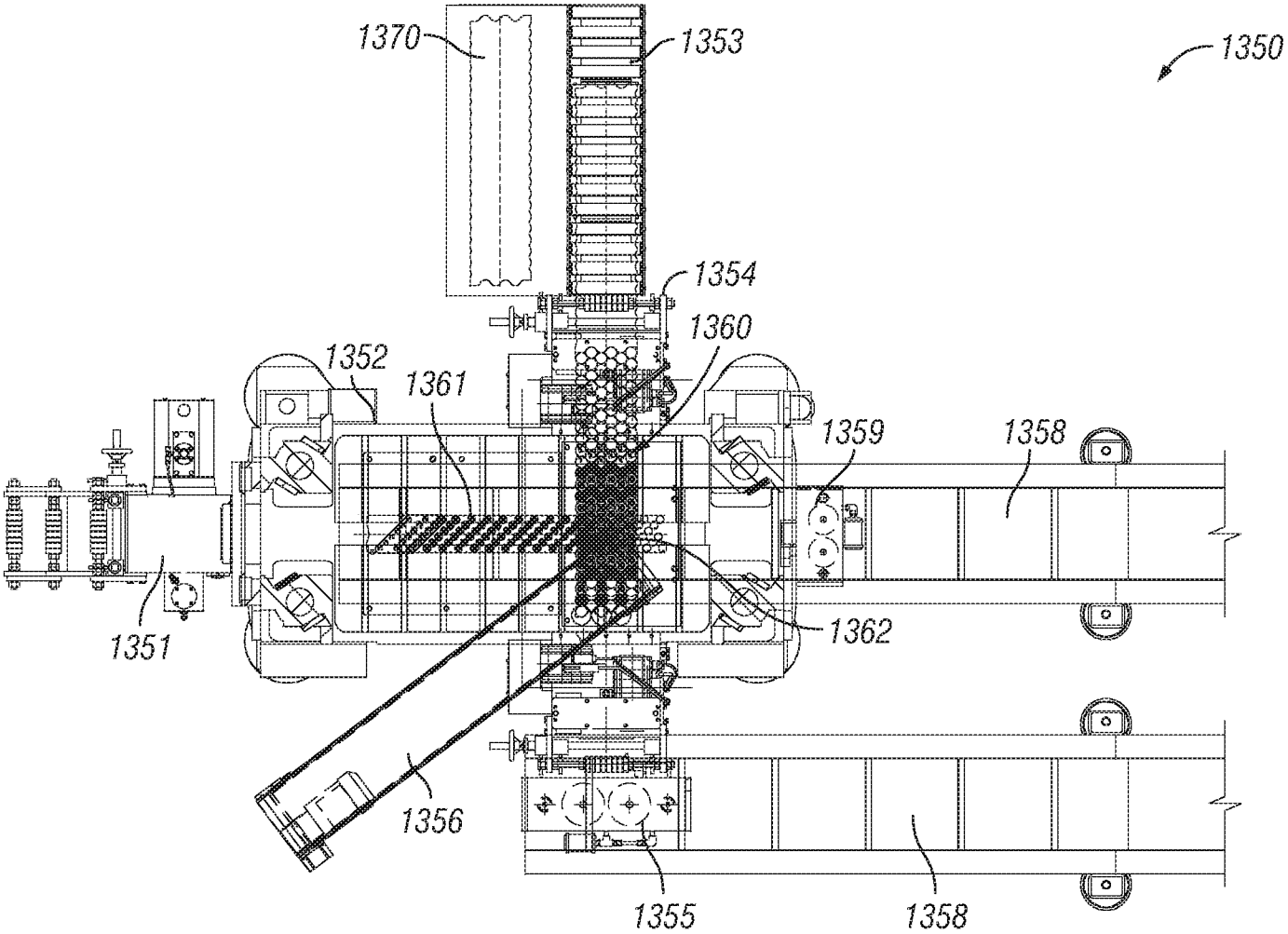
FIG. 13C illustrates a machine for forming ring pull crowns in accordance with an embodiment.

FIG. 13C illustrates a subsystem 1350 for forming ring pull crowns in accordance with an embodiment. In general, the subsystem 1350 is comprised of industrial automation equipment adapted to carry out an embodiment of the manufacturing process described above with respect to FIGS. 6-12. In certain embodiments, the subsystem 1350 may have a de-stacker and strip feeder 1353, a crown push servo feed 1354, a tab servo feed 1351, a first multi-stage die system 1360 for forming one or more crown bodies, a second multi-stage die system 1361 for forming one or more pull ring and tab assemblies, a third multi-stage die system 1362 for combining one or more crown bodies with one or more pull ring and tab assemblies, an exit conveyer 1356, scrap choppers 1355, and scrap conveyers 1358. Each of these multi-stage die presses may include one or more die presses and auxiliary equipment, as needed.

The subsystem 1350 receives a stack of crown body strips from strip feeder 1370 as input to the de-stacker component 1353. The de-stacker 1353 sequentially feeds the crown body strips via conveyer into the first multi-stage die system 1360, which is used to create the one or more crown bodies on the strip feed. A positive conveyer speed differential between the strip feeder 1353 and the conveyer of the crown push servo feed 1354 may be used to remove gaps between strips. In preferred embodiments where the ends of each strip have scalloped ends, the de-stacker and strip feeder 1353 will also ensure proper alignment of the edges such that the trailing edge of a first strip nests within the leading scalloped edge of a subsequent strip.

The pace of the continuous strip feed is controlled by a crown push servo feed 1354. A servomechanism, sometimes shortened to servo, is an automatic device that uses error-sensing negative feedback to correct the performance of a mechanism and is defined by its function. It usually includes a built-in encoder. A servomechanism is sometimes called a 'Heterostat' since it controls a system's behavior by means of Heterostasis. The term applies to systems where the feedback or error-correction signals help control mechanical position, speed or other parameters. As the crown push servo 1354 advances a crown body strip, a first multi-stage die system 1360 forms one or more crown bodies on the crown body strip. For example, a series of die stages may create score lines, form a rivet or rivet hole, emboss the crown body with recesses or dimples, and pre-cut the crown body from the sheet.

Simultaneous with the creation of the crown body, a separate, parallel manufacturing process is used to form the pull ring and tab assembly. A ring and tab coil 1380 provides a continuous input of tinplate to this second process, which is controlled and advanced by the tab servo feed 1354. Much like the crown body creation process, a second multi-stage die system 1361 may be used to form on or more pull ring and tab assemblies on the tinplate feed. For example, a series of die stages may cut ring and tab outlines, emboss tabs, form rivet holes, fold ring edges, fold tab edges, and curl or smooth the folded edges.

In the exemplary equipment 1350 illustrated by FIG. 13C, the crown body process flows from north to south and the pull ring and tab assembly process flow from west to east. In preferred embodiments, the conveyer line for the second process may be arranged above and perpendicular to the crown body process such that the two processes cross at a point which the ring and tab assembly is sufficiently formed such that it may be joined to a corresponding crown body. As illustrated above in FIG. 10, the staging for the ring and tab assembly may be diagonally staggered such that a single diagonal row of die punches may be used to combine the two processes. In order to match the angle formed by the tightly packed arrangement of crown bodies, in preferred embodiments, the diagonal rows of ring and tab assemblies should form a sixty-degree angle with respect to the crown body conveyer line.

In alternative embodiments, the second multi-stage die system 1361 for forming metallic pull-ring and tab assemblies could instead be replaced by a plastic molding machine, such as an injection molding process. Alternatively, the pull ring and tab assemblies could be pre-manufactured and simply combined with the crown bodies using a similar riveting process.

A third multi-stage die system or press 1362 may be used to align the pull ring and tab assembly with a corresponding crown body, cut the pull ring and tab from the tab sheet, attach the assembly to the crown using a rivet (either formed on the crown body or using a separate rivet), trim the assembled ring pull crown, and form the corrugated skirt. In accordance with one embodiment illustrated by FIG. 13C, the third process is positioned in line with the crown body conveyer line. When the final stage of the multi-stage die press 1362 separates a completed ring pull crown from the tinplate carrying web, the completed ring pull crown is deposited on the exit conveyer 1356, which will convey the completed product to a collection bin or to another quality control or packaging subsystem.

After the completed ring pull crown is separated from the remaining carrying web, the remaining unused crown body strip proceeds south along the conveyer until it is consumed by a scrap chopper 1355. The chopped scrap is deposited onto one or more scrap conveyers 1358, which transports the scrap into a scrap bin (not shown). Likewise, the leftover tinplate feed from the ring and tab coil is processed by a second scrap chopper 1359 located at the end of the pull ring and tab assembly process line. The scrap is carried by a second scrap conveyer 1360 to a scrap bin. In certain preferred embodiments, as shown in FIG. 13C, the two scrap conveyers 1358 should be arranged parallel to each other so that the scrap may be deposited in a common location.

Additional Manufactured Embodiments

Figure 14:
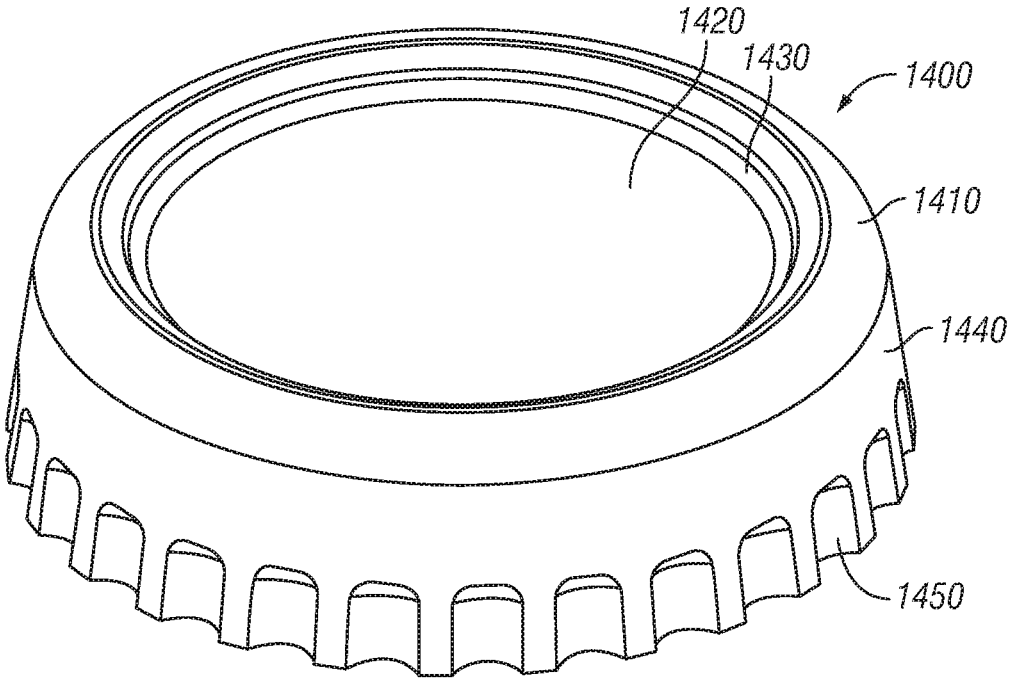
FIG. 14 illustrates an isometric view of an alternative embodiment of a crown that may be manufactured using the techniques and equipment disclosed herein.

FIG. 14 illustrates an isometric view of an alternative embodiment of a crown 1400 that may be manufactured using the techniques and equipment disclosed herein. Specifically, the crown 1400 in the embodiment is a reduced gauge crown, such as an RGC discussed in detail above. Such an RGC 1400 includes a crown body 1410 manufactured using techniques and processes similar to other crown bodies discussed above. In particular, the crown body 1410 of such an RGC 1400 includes the formation of one or more recesses 1420 concentric with the crown body 1410. Although the illustrated recess 1420 is a single recess with a uniform depressed surface below the top surface of the crown 1400, the disclosed techniques may be used to form multiple recesses or a recess with multiple levels, as desired. Moreover, transition areas 1430 may also be formed during the manufacturing process to create a smooth transition from the top of the crown 1400 to the depressed surface of the recess 1420. In addition, a skirt area 1440 may also be formed on the crown 1400 using the disclosed manufacturing techniques, and such skirt 1440 may include flutes 1450, as illustrated, or may include a smooth surface as discussed in detail below, depending on the application.

Figure 15:
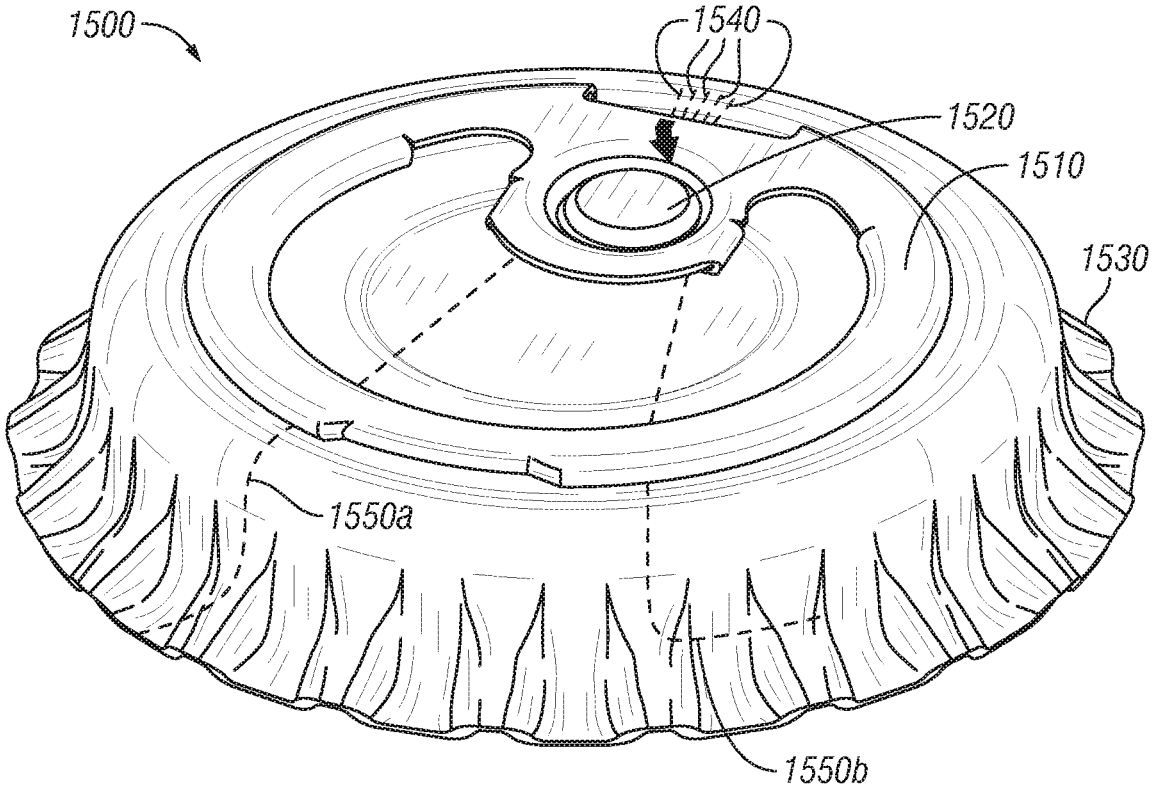
FIG. 15 illustrates a perspective top view of an alternative embodiment of a crown, similar to the crown of FIG. 1, that may be manufactured in accordance with the disclosed manufacturing techniques and principles.

FIG. 15 illustrates a perspective top view of an alternative embodiment of a crown 1500, similar to the crown of FIG. 1, that may be manufactured in accordance with the disclosed manufacturing techniques and principles. In this embodiment, the pull ring 1510 attachment location (i.e., rivet location 1520) is off-center from the center of the crown body. Thus, attachment location 1520 is closer to skirt 1530 than is the attachment location of pull ring in FIG. 1. In addition, additional score lines, noted collectively as rear score lines 1540, are also included in this embodiment of the crown 1500. This configuration of rear score lines 1540 are shown as non-parallel lines, any one of which alternative configurations can be implemented depending on engineering design choice. By providing the attachment location 1520 for the pull ring 1520 off-center, such embodiments of a crown 1500 constructed in accordance with the disclosed principles may provide additional leverage for tearing the crown 1500 during the opening and removal process. Specifically, once the crown 1500 is initially cracked by the raising of the front of the pull ring 1510, the user begins to pull the pull ring 1510 forward and slightly to the right (as visually indicated by the bold arrow).

By positioning the off-center location of the attachment portion 1520 towards the "rear" of the crown 1500, additional leverage is created for when the user pulls the pull ring 1510 towards the front of the crown 1500. Thus, additional leverage allows the user to more easily tear the score lines 1550*a* and 1550*b* during the opening process. Accordingly, the movement of the attachment location 1520 is not arbitrary, and is instead done so towards the rear of the crown 1500 in an effort to increase leverage during score line tearing. Additionally, the distance that the attachment location 1520 is moved off-center can be selected depending on the above of increased leverage desired. For example, if a thicker crown is employed, then more tearing leverage may be provided for easier opening. Of course, thickness of the crown 1500 need not be a consideration. Similarly, the number, length and alignment of the one or more of the rear score lines 1540 may also be selected depending on thickness of the crown 1500, among other considerations.

Figure 16A:
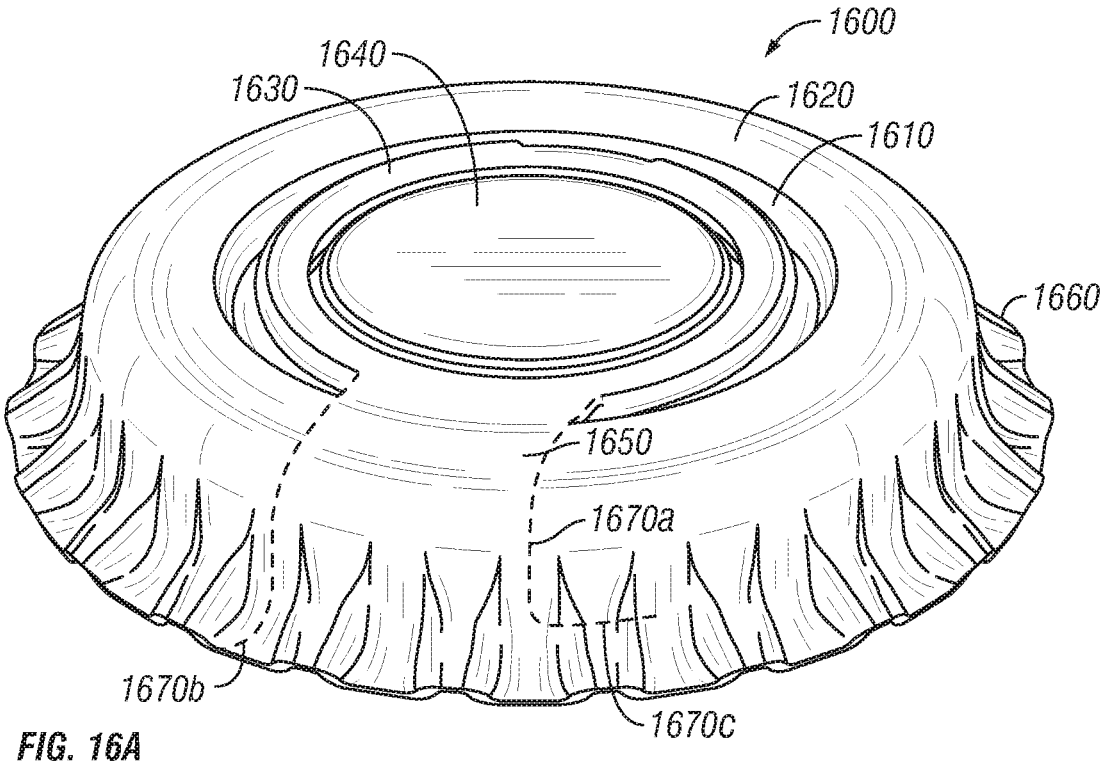
FIG. 16A is a perspective view of another alternative embodiment of a crown that may be manufactured in accordance with the disclosed manufacturing principles disclosed herein.
Figure 16B:
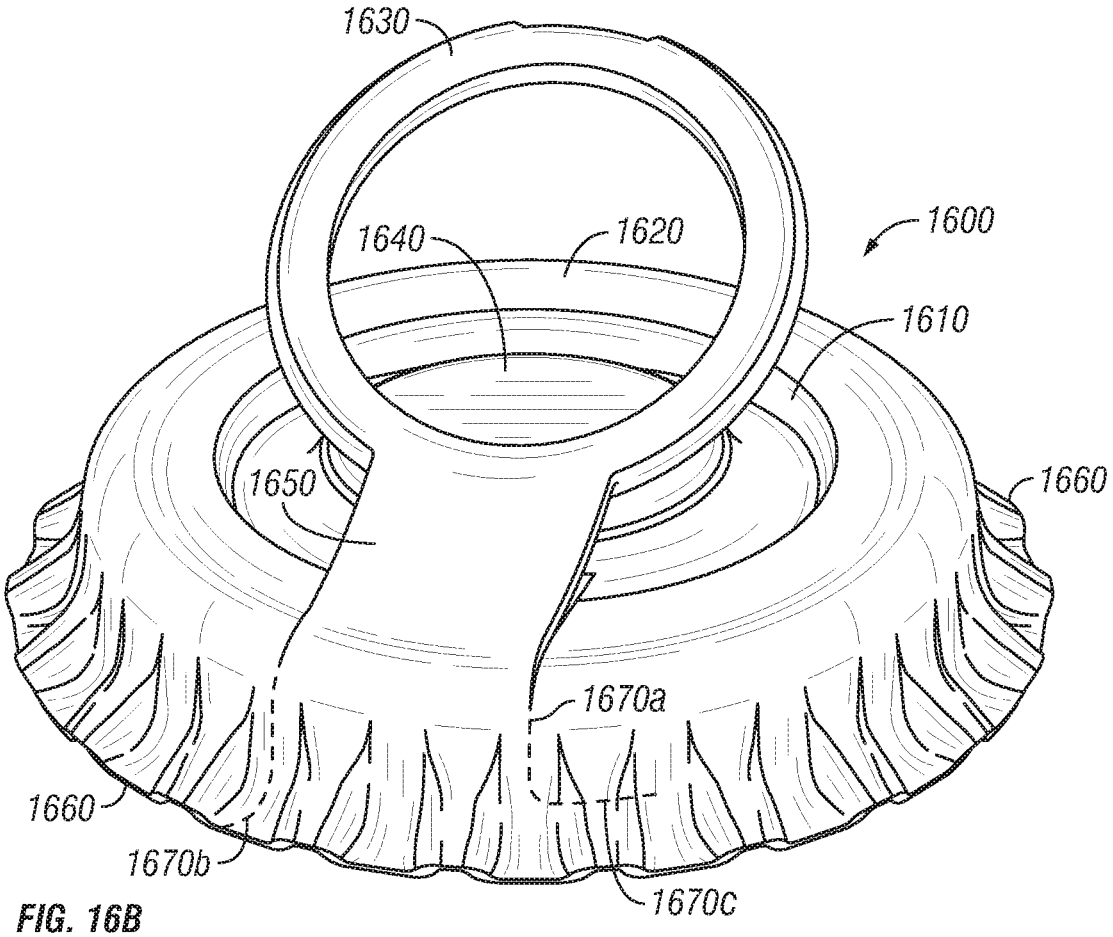
FIG. 16B is a perspective view of the crown of FIG. 16A as the crown is undergoing an opening operation.

FIG. 16A is a perspective view of another alternative embodiment of a crown 1600 that may be manufactured in accordance with the disclosed manufacturing principles disclosed herein. Specifically, the disclosed manufacturing techniques may be employed to form this embodiment of the crown 1600 with an integrated opener assembly. Annular groove 1610 is a recess, which may be formed similar to other recesses discussed herein, between top surface 1620 of crown 1600 and the pull ring 1630. The top surface of the ring tab 1630 and top surface 1620 are substantially coplanar, which maintains the ring tab 1630 even or below the surface of the crown 1600. In addition, the central portion 1640 of the crown body 1600 in this embodiment is not a rivet, but is instead a central plateau formed when groove 1610 is shaped by forming a recess in the top surface of the crown body using the disclosed techniques. Pull ring 1630 is disposed within groove 1610, while the tab portion 1650 extends from, and is formed integral with, skirt 1660. Score lines 1670*a* and 1670*b* define the lateral edges of pull tab portion 1650 and promote tearing open of the crown material along said score lines 1670 when crown 1600 is opened by pulling tab 1650 with pull ring 1630. FIG. 16B is a perspective view of the crown 1600 of FIG. 16A as the crown is undergoing an opening operation.

Figure 17A:
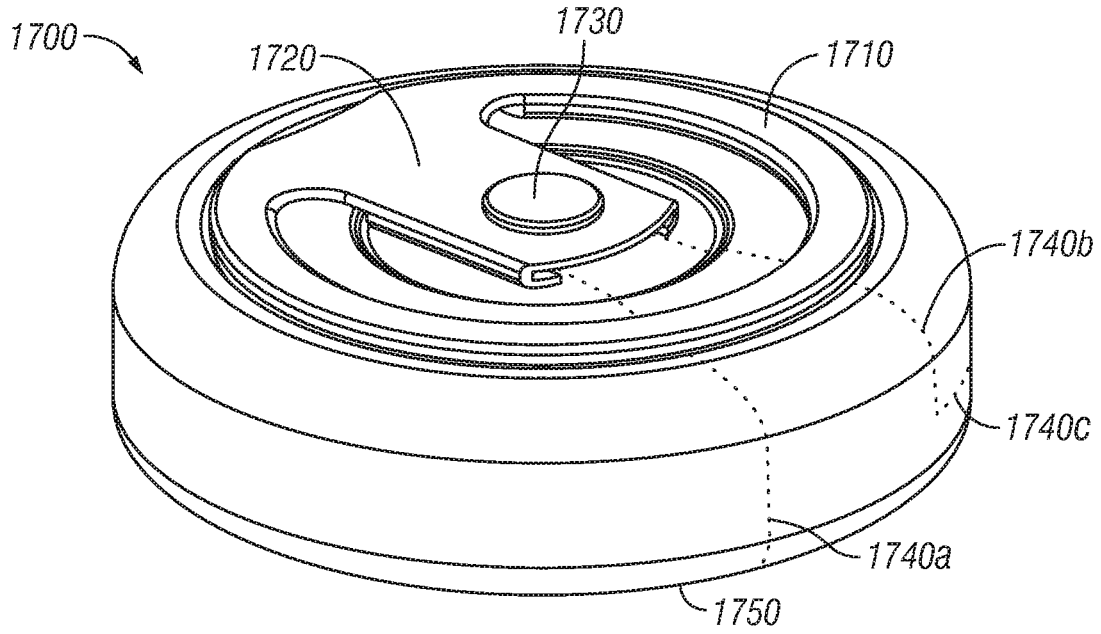
FIG. 17A illustrates a perspective top view of an alternative embodiment of a crown that may be manufactured using the disclosed manufacturing techniques and processes.

FIG. 17A illustrates a perspective top view of an alternative embodiment of a crown 1700 that may be manufactured using the disclosed manufacturing techniques and processes. The opener assembly of this embodiment of the crown 1700 again has a pull ring and tab assembly as discussed above, which includes pull ring 1710, tab portion 1720, and an attachment means 1730 (which may be a rivet as discussed above) to attach the opener assembly to the crown body of crown 1700. As may also be formed with the techniques discussed herein, the score lines 1740 in this embodiment of the crown 1700 comprise score line 1740*a*, which descends below the top of the crown 1700 and down to skirt 1750, as well as score line 1740*b*, which extends from the top of crown 1700 and then curves to form score line 1740*c*, which in turn traverses along the skirt 1750 substantially equidistant from top of the crown 1700 and bottom edge of skirt 1750.

Figure 17B:
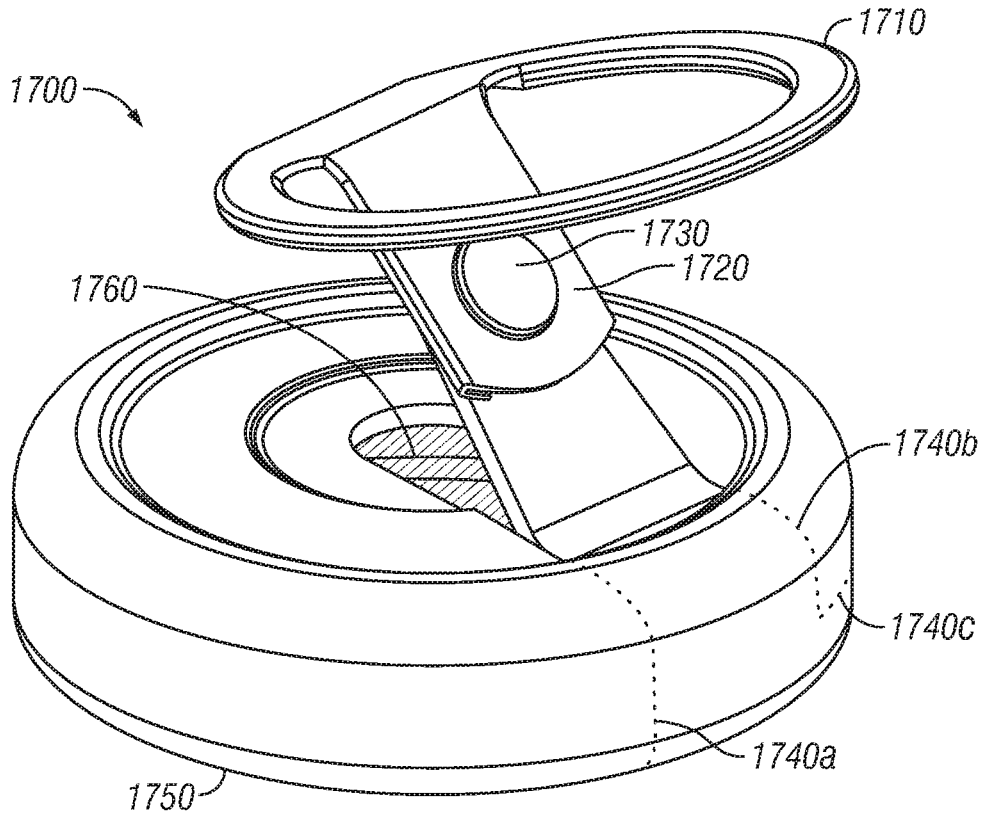
FIG. 17B is a perspective view of the crown of FIG. 17A as the crown is undergoing an opening operation.

Also in this embodiment of the crown 1700 manufactured in accordance with the disclosed principles, a membrane 1760 may be included under the top surface of the crown 1700. In this embodiment, such a membrane 1760 may be included in place of the liner typically found in bottle caps. More specifically, this embodiment of the crown 1700 may be used on a medical vial or other similar container, and thus the membrane 1760 may be a pierceable membrane to be pierced by a syringe or other similar medical device. Also important in this embodiment is the non-fluted skirt 1760. Specifically, the skirt 1750 in this embodiment may be formed by the above-described techniques so that it may be crimped around the medical vial container. Thus, this embodiment of the crown 1700 manufactured as disclosed herein is unique in that the skirt is "inverted" inward, yet the crown 1700 may still be torn and removed from the container. FIG. 17B is a perspective view of the crown 1700 of FIG. 17A as the crown is undergoing an opening operation. In this view, the underlying membrane 1760 may easily be seen.

Figure 18:
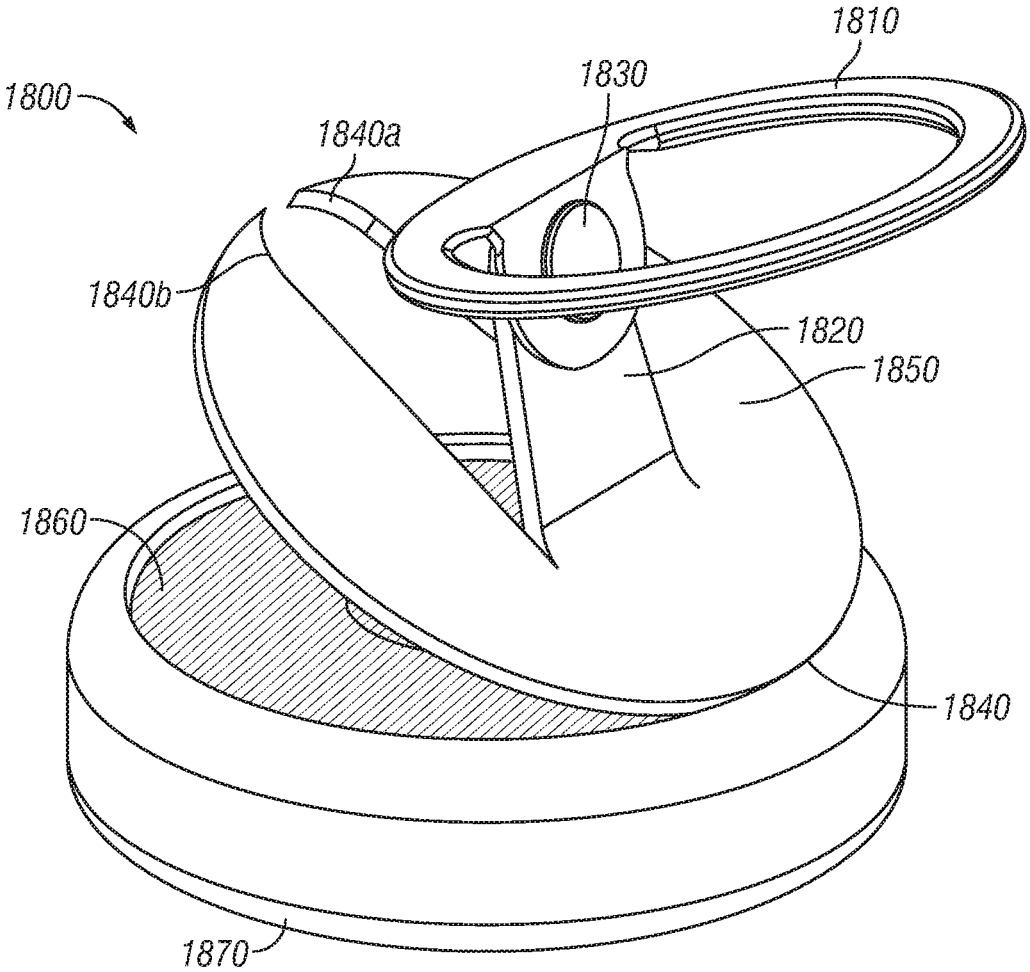
FIG. 18 illustrates a perspective top view of yet another alternative embodiment of a crown that may be manufactured using the disclosed manufacturing techniques and processes.

FIG. 18 illustrates a perspective top view of yet another alternative embodiment of a crown 1800 that may be manufactured using the disclosed manufacturing techniques and processes. The opener assembly of this embodiment of the crown 1800 again has a pull ring and tab assembly as discussed above, which includes pull ring 1810, tab portion 1820, and an attachment means 1830 (which again may be a rivet as discussed above) to attach the opener assembly to the crown body of crown 1800. As may also be formed with the techniques discussed herein, the score lines 1800 in this embodiment of the crown 1800 comprise score line 1840*a* and 1840*b*, which extend from proximate the perimeter of the crown top 1850 and continues across the central area of the crown top 1850. In addition, score line 1840*c* is provided that circumscribes the crown top 1850. The circumscribing score line 1840*c* is provided to allow complete removal of the crown top 1850 in this embodiment of the crown 1800. Also in this embodiment of the crown 1800 manufactured in accordance with the disclosed principles, a membrane 1860 may be included under the crown top 1850 of the crown 1800. As before, such a membrane 1860 may be included in place of the liner typically found in bottle caps. Thus, this embodiment of the crown 1800 may also be used on a medical vial or other similar container, and thus the membrane 1860 may be a pierceable membrane to be pierced by a syringe or other similar medical device. Also important in this embodiment is the non-fluted skirt 1870. Specifically, the skirt 1870 in this embodiment may be formed by the above-described techniques so that it may be crimped around the medical vial container. However, in this embodiment of the crown 1800 manufactured as disclosed herein is also unique in that the skirt 1870 is not only "inverted" inward, but can remain on the medical vial or other container after the crown top 1850 has been torn and removed from the container.

Figure 19:
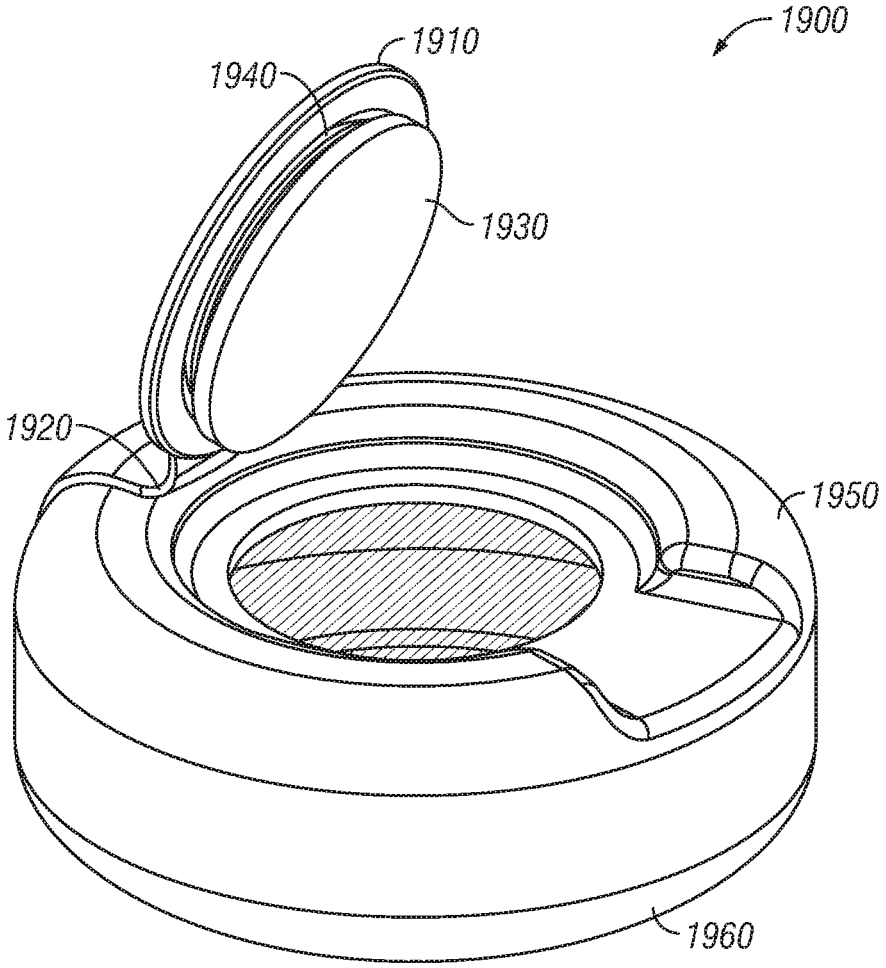
FIG. 19 is a perspective top view of another alternative embodiment of an crown that may be manufactured using the principles and techniques disclosed herein.

FIG. 19 is a perspective top view of another alternative embodiment of an crown 1900 that may be manufactured using the principles and techniques disclosed herein. This embodiment of the crown 1900 may again be employed for use with a medical vial or other similar container. Crown 1900 includes pull ring 1910, manufactured as described above for other embodiments. However, in this embodiment the pull ring 1910 is attached to flap hinge 1920 and to plug 1930, which has a top portion and a bottom portion. The top portion of plug 1930 and bottom portion form an annular receiving groove 1940. Pull ring 1910 fits snugly into groove 1940 so that when pull ring 1910 is pulled upward, plug 1930 is released from the crown top 1950 of crown 1900, pivoting on flap hinge 1920, to open the crown 1900. Pull ring 1910, plug 1930, and flap hinge 1920 form the opener assembly for crown 1900, and may all be manufactured in accordance with the disclosed principles. To facilitate operation of pull ring 1910, a portion of crown 1900 is recessed or depressed to accommodate a human finger nail or opening tool. This depressed portion makes it easier to access pull ring 1910 to operate the opener assembly. As in other embodiments discussed above, the crown 1900 includes a skirt 1960 that may be formed by the above-described techniques so that it may be crimped around the medical vial container. As with the embodiment illustrated in FIG. 18, in this embodiment of the crown 1900 the skirt 1960 is again "inverted" inward, and will remain on the medical vial or other container after the crown plug 1930 has been opened as described above.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived therefrom, such that structural, materials, and logical substitutions and changes may be made without departing from the scope of this disclosure. Figures are merely representational and may not be drawn to scale. Certain proportions thereof may be exaggerated, while others may be minimized. Accordingly, the specification and drawings are to be regarded in an illustrative rather than a restrictive sense.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A single machine for manufacturing a ring pull crown for a bottle opening, the single machine comprising:

a first multi-stage die system comprising a plurality of diagonal rows of die punches, at least one of said plurality of diagonal rows comprising each stage of the multi-stages, the first multi-stage die system adapted to:

form a plurality of crown bodies from a first source material, wherein the plurality of crown bodies are formed in parallel diagonal rows with respect to a longitudinal length of the first source material, and form a scoring line arrangement on each of the plurality of crown bodies, the scoring line arrangement comprising:

a first scoring line extending in a substantially linear radial direction from a center area of a top of each crown body to a portion from which is formed a lower edge of a skirt of each crown body; and a second scoring line comprising:

an upper radial segment extending in a substantially linear direction from the center area of the top of each crown body to the skirt of each crown body, and a lower annular segment extending circumferentially along the skirt in an annular direction and extending from a terminus of the upper radial segment, the lower annular segment defined in a second horizontal plane spaced from a first horizontal plane defined along the lower edge of the skirt;

a second multi-stage die system comprising a plurality of diagonal rows of die punches, at least one of said plurality of diagonal rows comprising each stage of the multi-stages, the second multi-stage die system adapted to form a plurality of pull ring and tab assemblies from a second source material simultaneously with the forming of the plurality of crown bodies by the first multi-stage die system, wherein the plurality of pull ring and tab assemblies are formed in parallel diagonal rows with respect to a longitudinal length of the second source material; and a third multi-stage die system comprising at least one diagonal row of die punches adapted to:

form a plurality of ring pull crowns by simultaneously combining each crown body of a diagonal row of the plurality of crown bodies with a corresponding diagonal row of pull ring and tab assemblies of the plurality of pull ring and tab assemblies, form the skirt that descends below a top of each ring pull crown, and remove the plurality of ring pull crowns from the first source material.

2. The single machine of claim 1, further comprising a first source material feeding system connected thereto and adapted to:

cut the first source material into a plurality of rectangular strips;

form scalloped edges on two opposite ends of each rectangular strip of the plurality of rectangular strips; and nest a first scalloped edge of a first rectangular strip of the plurality of rectangular strips in a second scalloped edge of a second rectangular strip of the plurality of rectangular strips.

3. The single machine of claim 2, wherein the first source material feeding system is further adapted to stack the plurality of rectangular strips.

4. The single machine of claim 2, wherein the scalloped edges are curvilinear.

5. The single machine of claim 1, wherein the second multi-stage die system comprises a progressive die press adapted to form the plurality of pull ring and tab assemblies from the second source material using two or more die stages, and wherein two or more dies of a die stage from the two or more die stages are arranged in a diagonal row with respect to a feed direction of the second source material.

6. The single machine of claim 1, wherein the third multi-stage die system is further adapted to form the circumferential skirt for each ring pull crown by simultaneously forming circumferential skirts for a single diagonal row of ring pull crowns formed by the diagonal row of crown bodies combined with the diagonal row of pull ring and tab assemblies.

7. The single machine of claim 1, wherein the first multi-stage die system is further adapted to form a rivet on each crown body in the plurality of crown bodies, and wherein the second multi-stage die system is further adapted to punch a rivet hole in each pull ring and tab assembly in the plurality of pull ring and tab assemblies.

8. The single machine of claim 7, wherein the third multi-stage die system is further adapted to:

align the first source material over the second source material;

separate the diagonal row of pull ring and tab assemblies from the first source material; and attach each pull ring and tab assembly of the diagonal row of pull ring and tab assemblies to a corresponding crown body in the diagonal row of crown bodies by compressing each pull ring and tab assembly onto a corresponding crown body.

9. The single machine of claim 1, wherein the first multi-stage die system is further adapted to form one or more recessed portions on each crown body of the plurality of crown bodies, wherein the one or more recessed portions form corrugated cross-sections in each crown body.

10. The single machine of claim 9, wherein the one or more recessed portions comprise a recessed seat for nesting an attached pull ring and tab assembly, and wherein the recessed seat is suitably dimensioned such that a top surface of the attached pull ring and tab assembly is flush with an adjacent shoulder of the corresponding crown body.

11. The single machine of claim 1, wherein the first multi-stage die system comprises a series of die stages configured to create the scoring line arrangement, form a rivet or rivet hole, emboss the crown body with recesses or dimples, and pre-cut the crown bodies from the first source material.

12. The single machine of claim 11, wherein the second multi-stage die system comprises a series of die stages configured to, simultaneously with the first multi-stage die system, cut ring and tab outlines, emboss tabs, form rivet holes, fold ring pull edges, fold tab edges, and curl or smooth the folded edges from the second source material.

13. The single machine of claim 12, wherein the third multi-stage die system is further adapted to align a pull ring and tab assembly on the first source material with a corresponding crown body on the second source material, cut the pull ring and tab from the second source material, attach the pull ring and tab assembly to the corresponding crown body using a rivet, trim the assembled ring pull crown, and form the skirt on the crown.

14. The single machine of claim 1, wherein the first source material is tinplate and the second source material is non-metal.

15. The single machine of claim 1, wherein the second source material comprises a plastic or a synthetic resin.

16. The single machine of claim 1, wherein the first source material comprises a printed design.

* * * * *